US008463443B2

(12) United States Patent
Grohman et al.

(10) Patent No.: US 8,463,443 B2
(45) Date of Patent: Jun. 11, 2013

(54) MEMORY RECOVERY SCHEME AND DATA STRUCTURE IN A HEATING, VENTILATION AND AIR CONDITIONING NETWORK

(75) Inventors: Wojciech Grohman, Little Elm, TX (US); Darko Hadzidedic, Plano, TX (US)

(73) Assignee: Lennox Industries, Inc., Richardson, TX (US)

( * ) Notice: Subject to any disclaimer, the term of this patent is extended or adjusted under 35 U.S.C. 154(b) by 607 days.

(21) Appl. No.: 12/603,528

(22) Filed: Oct. 21, 2009

(65) Prior Publication Data

US 2010/0106815 A1 Apr. 29, 2010

Related U.S. Application Data

(63) Continuation-in-part of application No. 12/258,659, filed on Oct. 27, 2008.

(60) Provisional application No. 61/167,135, filed on Apr. 6, 2009.

(51) Int. Cl.
*G01M 1/38* (2006.01)

(52) U.S. Cl.
USPC ..... 700/276

(58) Field of Classification Search
USPC ... 700/20, 83, 276, 277, 278, 299, 300; 236/1 C, 91 D
See application file for complete search history.

(56) References Cited

U.S. PATENT DOCUMENTS

| | | | |
|---|---|---|---|
| 4,048,491 | A | 9/1977 | Wessman |
| 4,262,736 | A | 4/1981 | Gilkeson et al. |
| 4,296,464 | A | 10/1981 | Woods et al. |
| 4,381,549 | A | 4/1983 | Stamp et al. |
| 4,464,543 | A | 8/1984 | Kline et al. |
| 4,482,785 | A | 11/1984 | Finnegan et al. |
| 4,501,125 | A | 2/1985 | Han |
| 4,606,042 | A | 8/1986 | Kahn et al. |
| 4,616,325 | A | 10/1986 | Heckenbach et al. |
| 4,694,394 | A | 9/1987 | Costantini |

(Continued)

FOREIGN PATENT DOCUMENTS

| | | |
|---|---|---|
| EP | 0980165 A2 | 2/2000 |
| EP | 1956311 A2 | 8/2008 |

(Continued)

OTHER PUBLICATIONS

Related case U.S. Appl. No. 12/603,508, filed Oct. 21, 2009 to Wojciech Grohman, entitled "Alarm and Diagnostics System and Method for a Distributed-Architecture Heating, Ventilation and Air Conditioning Network".

(Continued)

*Primary Examiner* — Kavita Padmanabhan
*Assistant Examiner* — Chad Rapp

(57) ABSTRACT

The disclosure provides systems and methods for conveying information between a communicating first device and a second coupled device of a HVAC network. In various embodiments, the method comprises checking a subnet of the HVAC network for both communicating device and a non-communicating device by the communicating first device. The method also comprises determining whether the second coupled device in a non-communicating device. The method further comprises allowing an installer to set parameters of the non-communicating device through employment of a manifest list of features used by the non-communicating device that is accessible by the communicating device.

20 Claims, 18 Drawing Sheets

U.S. PATENT DOCUMENTS

| | | | |
|---|---|---|---|
| 4,698,628 | A | 10/1987 | Herkert et al. |
| 4,703,325 | A | 10/1987 | Chamberlin et al. |
| 4,706,247 | A | 11/1987 | Yoshioka |
| 4,723,239 | A | 2/1988 | Schwartz |
| 4,829,447 | A | 5/1989 | Parker et al. |
| 4,841,450 | A | 6/1989 | Fredriksson |
| 4,843,084 | A | 6/1989 | Parker et al. |
| 4,873,649 | A | 10/1989 | Grald et al. |
| 4,884,214 | A | 11/1989 | Parker et al. |
| 4,887,262 | A | 12/1989 | van Veldhuizen |
| 4,888,728 | A | 12/1989 | Shirakawa et al. |
| 4,889,280 | A | 12/1989 | Grald et al. |
| 4,931,948 | A | 6/1990 | Parker et al. |
| 4,941,143 | A | 7/1990 | Twitty et al. |
| 4,942,613 | A | 7/1990 | Lynch |
| 4,947,484 | A | 8/1990 | Twitty et al. |
| 4,947,928 | A | 8/1990 | Parker et al. |
| 4,953,083 | A | 8/1990 | Takata et al. |
| 4,955,018 | A | 9/1990 | Twitty et al. |
| 4,967,567 | A | 11/1990 | Proctor et al. |
| 4,978,896 | A | 12/1990 | Shah |
| 4,991,770 | A | 2/1991 | Bird et al. |
| 4,996,513 | A | 2/1991 | Mak et al. |
| 5,006,827 | A | 4/1991 | Brueton et al. |
| 5,018,138 | A | 5/1991 | Twitty et al. |
| 5,039,980 | A | 8/1991 | Aggers et al. |
| 5,042,997 | A | 8/1991 | Rhodes |
| 5,058,388 | A | 10/1991 | Shaw et al. |
| 5,061,916 | A | 10/1991 | French et al. |
| 5,065,813 | A | 11/1991 | Berkeley et al. |
| 5,086,385 | A | 2/1992 | Launey et al. |
| 5,103,896 | A | 4/1992 | Saga |
| 5,105,366 | A | 4/1992 | Beckey |
| 5,115,967 | A | 5/1992 | Wedekind |
| 5,128,855 | A | 7/1992 | Hilber et al. |
| 5,165,465 | A | 11/1992 | Kenet |
| 5,170,935 | A | 12/1992 | Federspiel et al. |
| 5,180,102 | A | 1/1993 | Gilbert et al. |
| 5,181,653 | A | 1/1993 | Foster et al. |
| 5,184,122 | A | 2/1993 | Decious et al. |
| 5,191,643 | A | 3/1993 | Alsenz |
| 5,195,327 | A | 3/1993 | Kim |
| 5,197,666 | A | 3/1993 | Wedekind |
| 5,197,668 | A | 3/1993 | Ratz et al. |
| 5,203,497 | A | 4/1993 | Ratz et al. |
| 5,220,260 | A | 6/1993 | Schuler |
| 5,230,482 | A | 7/1993 | Ratz et al. |
| 5,259,553 | A | 11/1993 | Shyu |
| 5,274,571 | A | 12/1993 | Hessee et al. |
| 5,276,630 | A | 1/1994 | Baldwin et al. |
| 5,277,036 | A | 1/1994 | Dieckmann et al. |
| 5,278,957 | A | 1/1994 | Chan |
| 5,279,458 | A | 1/1994 | DeWolf et al. |
| 5,297,143 | A | 3/1994 | Fridrich et al. |
| 5,314,004 | A | 5/1994 | Strand et al. |
| 5,323,385 | A | 6/1994 | Jurewicz et al. |
| 5,323,619 | A | 6/1994 | Kim |
| 5,327,426 | A | 7/1994 | Dolin, Jr. et al. |
| 5,329,991 | A | 7/1994 | Mehta et al. |
| 5,337,952 | A | 8/1994 | Thompson |
| 5,341,988 | A | 8/1994 | Rein et al. |
| 5,355,323 | A | 10/1994 | Bae |
| 5,361,982 | A | 11/1994 | Liebl et al. |
| 5,374,200 | A | 12/1994 | Giroux |
| 5,383,116 | A | 1/1995 | Lennartsson |
| 5,384,697 | A | 1/1995 | Pascucci |
| 5,414,337 | A | 5/1995 | Schuler |
| 5,417,368 | A | 5/1995 | Jeffery et al. |
| 5,420,572 | A | 5/1995 | Dolin, Jr. et al. |
| 5,434,965 | A | 7/1995 | Matheny et al. |
| 5,440,895 | A | 8/1995 | Bahel et al. |
| 5,444,626 | A | 8/1995 | Schenk |
| 5,444,851 | A | 8/1995 | Woest |
| 5,448,180 | A | 9/1995 | Kienzler et al. |
| 5,448,561 | A | 9/1995 | Kaiser et al. |
| 5,449,047 | A | 9/1995 | Schivley, Jr. |
| 5,450,570 | A | 9/1995 | Richek et al. |
| 5,452,201 | A | 9/1995 | Pieronek et al. |
| 5,460,327 | A | 10/1995 | Hill et al. |
| 5,463,735 | A | 10/1995 | Pascucci et al. |
| 5,469,150 | A | 11/1995 | Sitte |
| 5,475,364 | A | 12/1995 | Kenet |
| 5,481,481 | A | 1/1996 | Frey et al. |
| 5,481,661 | A | 1/1996 | Kobayashi |
| 5,488,834 | A | 2/1996 | Schwarz |
| 5,491,649 | A | 2/1996 | Friday, Jr. et al. |
| 5,502,818 | A | 3/1996 | Lamberg |
| 5,511,188 | A | 4/1996 | Pascucci et al. |
| 5,513,324 | A | 4/1996 | Dolin, Jr. et al. |
| 5,515,267 | A | 5/1996 | Alsenz |
| 5,520,328 | A | 5/1996 | Bujak, Jr. |
| 5,522,044 | A | 5/1996 | Pascucci et al. |
| 5,530,643 | A | 6/1996 | Hodorowski |
| 5,537,339 | A | 7/1996 | Naganuma et al. |
| 5,539,778 | A | 7/1996 | Kienzler et al. |
| 5,544,036 | A | 8/1996 | Brown et al. |
| 5,544,809 | A | 8/1996 | Keating et al. |
| 5,550,980 | A | 8/1996 | Pascucci et al. |
| 5,551,053 | A | 8/1996 | Nadolski et al. |
| 5,555,269 | A | 9/1996 | Friday, Jr. et al. |
| 5,555,509 | A | 9/1996 | Dolan et al. |
| 5,559,407 | A | 9/1996 | Dudley et al. |
| 5,559,412 | A | 9/1996 | Schuler |
| 5,566,879 | A | 10/1996 | Longtin |
| 5,572,658 | A | 11/1996 | Mohr et al. |
| 5,574,848 | A | 11/1996 | Thomson |
| 5,579,221 | A | 11/1996 | Mun |
| 5,581,478 | A | 12/1996 | Cruse et al. |
| 5,592,058 | A | 1/1997 | Archer et al. |
| 5,592,059 | A | 1/1997 | Archer |
| 5,592,628 | A | 1/1997 | Ueno et al. |
| 5,596,437 | A | 1/1997 | Heins |
| 5,598,566 | A | 1/1997 | Pascucci et al. |
| 5,600,782 | A | 2/1997 | Thomson |
| 5,613,369 | A | 3/1997 | Sato et al. |
| 5,617,282 | A | 4/1997 | Rall et al. |
| 5,621,662 | A | 4/1997 | Humphries et al. |
| 5,628,201 | A | 5/1997 | Bahel et al. |
| 5,630,325 | A | 5/1997 | Bahel et al. |
| 5,631,825 | A | 5/1997 | van Weele et al. |
| 5,634,590 | A | 6/1997 | Gorski et al. |
| 5,675,756 | A | 10/1997 | Benton et al. |
| 5,675,830 | A | 10/1997 | Satula |
| 5,684,463 | A | 11/1997 | Diercks et al. |
| 5,684,717 | A | 11/1997 | Beilfuss et al. |
| 5,699,243 | A | 12/1997 | Eckel et al. |
| 5,706,190 | A | 1/1998 | Russ et al. |
| 5,711,480 | A | 1/1998 | Zepke et al. |
| 5,720,604 | A | 2/1998 | Kelly et al. |
| 5,722,822 | A | 3/1998 | Wilson et al. |
| 5,726,900 | A | 3/1998 | Walter et al. |
| 5,729,442 | A | 3/1998 | Frantz |
| 5,737,529 | A | 4/1998 | Dolin, Jr. et al. |
| 5,748,923 | A | 5/1998 | Eitrich |
| 5,751,572 | A | 5/1998 | Maciulewicz |
| 5,751,948 | A | 5/1998 | Dolan et al. |
| 5,754,779 | A | 5/1998 | Dolin, Jr. et al. |
| 5,761,083 | A | 6/1998 | Brown, Jr. et al. |
| 5,764,146 | A | 6/1998 | Baldwin et al. |
| 5,772,326 | A | 6/1998 | Batko et al. |
| 5,772,732 | A | 6/1998 | James et al. |
| 5,774,322 | A | 6/1998 | Walter et al. |
| 5,774,492 | A | 6/1998 | Orlowsik, Jr. et al. |
| 5,774,493 | A | 6/1998 | Ross |
| 5,777,837 | A | 7/1998 | Eckel et al. |
| 5,782,296 | A | 7/1998 | Mehta |
| 5,784,647 | A | 7/1998 | Sugimoto |
| 5,786,993 | A | 7/1998 | Frutiger et al. |
| 5,787,027 | A | 7/1998 | Dolan et al. |
| 5,791,332 | A | 8/1998 | Thompson et al. |
| 5,793,646 | A | 8/1998 | Hibberd et al. |
| 5,801,942 | A | 9/1998 | Nixon et al. |
| 5,802,485 | A | 9/1998 | Koelle et al. |
| 5,803,357 | A | 9/1998 | Lakin |
| 5,809,063 | A | 9/1998 | Ashe et al. |
| 5,809,556 | A | 9/1998 | Fujisawa et al. |
| 5,816,492 | A | 10/1998 | Charles et al. |

5,818,347 A 10/1998 Dolan et al.
5,819,845 A 10/1998 Ryu et al.
5,822,512 A 10/1998 Goodrum et al.
5,826,038 A 10/1998 Nakazumi
5,829,674 A 11/1998 Vanostrand et al.
5,841,654 A 11/1998 Verissimo et al.
5,848,887 A 12/1998 Zabielski et al.
5,854,744 A 12/1998 Zeng et al.
5,856,972 A 1/1999 Riley et al.
5,860,411 A 1/1999 Thompson et al.
5,860,473 A 1/1999 Seiden
5,862,052 A 1/1999 Nixon et al.
5,862,411 A 1/1999 Kay et al.
5,864,581 A 1/1999 Alger-Meunier et al.
5,873,519 A 2/1999 Beilfuss
5,878,236 A 3/1999 Kleineberg et al.
5,883,627 A 3/1999 Pleyer
5,884,072 A 3/1999 Rasmussen
5,892,690 A 4/1999 Boatman et al.
5,896,304 A 4/1999 Tiemann et al.
5,900,674 A 5/1999 Wojnarowski et al.
5,903,454 A 5/1999 Hoffberg et al.
5,912,877 A 6/1999 Shirai et al.
5,914,453 A 6/1999 James et al.
5,915,101 A 6/1999 Kleineberg et al.
5,924,486 A 7/1999 Ehlers et al.
5,927,398 A 7/1999 Maciulewicz
5,930,249 A 7/1999 Stademann et al.
5,933,655 A 8/1999 Vrabec et al.
5,934,554 A 8/1999 Charles et al.
5,937,942 A 8/1999 Bias et al.
5,946,209 A 8/1999 Eckel et al.
5,971,597 A 10/1999 Baldwin et al.
5,973,594 A 10/1999 Baldwin et al.
5,983,353 A 11/1999 McHann, Jr.
5,983,646 A 11/1999 Grothe et al.
5,993,195 A 11/1999 Thompson
6,006,142 A 12/1999 Seem et al.
6,011,821 A 1/2000 Sauer et al.
6,021,252 A 2/2000 Faris et al.
6,028,864 A 2/2000 Marttinen et al.
6,032,178 A 2/2000 Bacigalupo et al.
6,035,024 A 3/2000 Stumer
6,046,410 A 4/2000 Wojnarowski et al.
6,049,817 A 4/2000 Schoen et al.
6,052,525 A 4/2000 Carlson et al.
6,053,416 A 4/2000 Specht et al.
6,061,600 A 5/2000 Ying
6,061,603 A 5/2000 Papadopoulos et al.
6,078,660 A 6/2000 Burgess
6,082,894 A 7/2000 Batko et al.
6,092,280 A 7/2000 Wojnarowski
6,095,674 A 8/2000 Verissimo et al.
6,098,116 A 8/2000 Nixon et al.
6,101,824 A 8/2000 Meyer et al.
6,110,260 A 8/2000 Kubokawa
6,115,713 A 9/2000 Pascucci et al.
6,138,227 A 10/2000 Thewes et al.
6,141,595 A 10/2000 Gloudeman et al.
6,145,501 A 11/2000 Manohar et al.
6,145,751 A 11/2000 Ahmed
6,147,601 A 11/2000 Sandelman et al.
6,151,298 A 11/2000 Bernhardsson et al.
6,151,529 A 11/2000 Batko
6,151,625 A 11/2000 Swales et al.
6,151,650 A 11/2000 Birzer
6,155,341 A 12/2000 Thompson et al.
6,160,477 A 12/2000 Sandelman et al.
6,160,484 A 12/2000 Spahl et al.
6,160,795 A 12/2000 Hosemann
6,167,338 A 12/2000 De Wille et al.
6,169,937 B1 1/2001 Peterson
6,169,964 B1 1/2001 Alsa et al.
6,170,044 B1 1/2001 McLaughlin et al.
6,177,945 B1 1/2001 Pleyer
6,179,213 B1 1/2001 Gibino et al.
6,182,130 B1 1/2001 Dolin, Jr. et al.
6,188,642 B1 2/2001 Schoniger et al.
6,190,442 B1 2/2001 Redner
6,208,905 B1 3/2001 Giddings et al.
6,208,924 B1 3/2001 Bauer
6,211,782 B1 4/2001 Sandelman et al.
6,216,066 B1 4/2001 Goebel et al.
6,227,191 B1 5/2001 Garloch
6,232,604 B1 5/2001 McDaniel et al.
6,237,113 B1 5/2001 Daiber
6,240,326 B1 5/2001 Gloudeman et al.
6,241,156 B1 6/2001 Kline et al.
6,252,890 B1 6/2001 Alger-Meunier et al.
6,254,009 B1 7/2001 Proffitt et al.
6,266,205 B1 7/2001 Schreck et al.
6,269,127 B1 7/2001 Richards
6,271,845 B1 8/2001 Richardson
6,282,454 B1 8/2001 Papadopoulos et al.
6,285,912 B1 9/2001 Ellison et al.
6,292,518 B1 9/2001 Grabb et al.
6,298,376 B1 10/2001 Rosner et al.
6,298,454 B1 10/2001 Schleiss et al.
6,298,551 B1 10/2001 Wojnarowski et al.
6,304,557 B1 10/2001 Nakazumi
6,307,331 B1 10/2001 Bonasia et al.
6,324,008 B1 11/2001 Baldwin et al.
6,324,854 B1 12/2001 Jayanth
6,336,065 B1 1/2002 Gibson et al.
6,343,236 B1 1/2002 Gibson et al.
6,349,306 B1 2/2002 Malik et al.
6,349,883 B1 2/2002 Simmons et al.
6,353,775 B1 3/2002 Nichols
6,359,220 B2 3/2002 Schiedegger et al.
6,370,037 B1 4/2002 Schoenfish
6,374,373 B1 4/2002 Helm et al.
6,377,283 B1 4/2002 Thomas
6,385,510 B1 5/2002 Hoog et al.
6,390,806 B1 5/2002 Dempsey et al.
6,393,023 B1 5/2002 Shimizu et al.
6,400,996 B1 6/2002 Hoffberg et al.
6,405,104 B1 6/2002 Dougherty
6,408,228 B1 6/2002 Seem et al.
6,411,701 B1 6/2002 Stademann
6,411,857 B1 6/2002 Flood
6,412,435 B1 7/2002 Timmons, Jr.
6,415,395 B1 7/2002 Varma et al.
6,418,507 B1 7/2002 Fackler
6,423,118 B1 7/2002 Becerra et al.
6,424,872 B1 7/2002 Glanzer et al.
6,424,874 B1 7/2002 Cofer
6,427,454 B1 8/2002 West
6,429,845 B1 8/2002 Unseld et al.
6,430,953 B2 8/2002 Roh
6,434,715 B1 8/2002 Andersen
6,435,418 B1 8/2002 Toth et al.
6,437,691 B1 8/2002 Sandelman et al.
6,437,805 B1 8/2002 Sojoodi et al.
6,441,723 B1 8/2002 Mansfield et al.
6,442,952 B2 9/2002 Roh et al.
6,448,896 B1 9/2002 Bankus et al.
6,449,315 B2 9/2002 Richards
6,450,409 B1 9/2002 Rowlette et al.
6,453,374 B1 9/2002 Kovalan et al.
6,454,177 B1 9/2002 Sasao et al.
6,462,654 B1 10/2002 Sandelman et al.
6,478,084 B1 11/2002 Kumar et al.
6,493,661 B1 12/2002 White et al.
6,497,570 B1 12/2002 Sears et al.
6,498,844 B1 12/2002 Stademann
6,501,995 B1 12/2002 Kinney et al.
6,504,338 B1 1/2003 Eichorn
6,505,087 B1 1/2003 Lucas et al.
6,508,407 B1 1/2003 Lefkowitz et al.
6,526,122 B2 2/2003 Matsushita et al.
6,535,123 B2 3/2003 Sandelman et al.
6,535,138 B1 3/2003 Dolan et al.
6,539,489 B1 3/2003 Reinert
6,540,148 B1 4/2003 Salsbury et al.
6,542,462 B1 4/2003 Sohraby et al.
6,543,007 B1 4/2003 Bliley et al.
6,545,660 B1 4/2003 Shen et al.
6,546,008 B1 4/2003 Wehrend 6,552,647 B1 4/2003 Thiessen et al.
6,554,198 B1 4/2003 Hull et al.
6,560,976 B2 5/2003 Jayanth
6,564,348 B1 5/2003 Barenys et al.
6,567,476 B2 5/2003 Kohl et al.
6,572,363 B1 6/2003 Virgil, Jr. et al.
6,574,215 B2 6/2003 Hummel
6,574,234 B1 6/2003 Myer et al.
6,574,581 B1 6/2003 Bohrer et al.
6,575,233 B1 6/2003 Krumnow
6,580,950 B1 6/2003 Johnson et al.
6,587,039 B1 7/2003 Woestemeyer et al.
6,587,739 B1 7/2003 Abrams et al.
6,587,884 B1 7/2003 Papadopoulos et al.
6,594,272 B1 7/2003 Ketcham et al.
6,595,430 B1 7/2003 Shah
6,600,923 B1 7/2003 Dzuban
6,608,560 B2 8/2003 Abrams
6,609,127 B1 8/2003 Lee et al.
6,615,088 B1 9/2003 Myer et al.
6,615,594 B2 9/2003 Jayanth et al.
6,618,394 B1 9/2003 Hilleary
6,619,555 B2 9/2003 Rosen
6,621,507 B1 9/2003 Shah
6,622,926 B1 9/2003 Sartain et al.
6,628,993 B1 9/2003 Bauer
6,633,781 B1 10/2003 Lee et al.
6,636,771 B1 10/2003 Varma et al.
6,640,145 B2 10/2003 Hoffberg et al.
6,640,890 B1 11/2003 Dage et al.
6,643,689 B2 11/2003 Rode et al.
6,644,557 B1 11/2003 Jacobs
6,647,317 B2 11/2003 Takai et al.
6,650,949 B1 11/2003 Fera et al.
6,651,034 B1 11/2003 Hedlund et al.
6,658,373 B2 12/2003 Rossi et al.
RE38,406 E 1/2004 Faris et al.
6,681,215 B2 1/2004 Jammu
6,688,387 B1 2/2004 Wellington et al.
6,704,688 B2 3/2004 Aslam et al.
6,708,239 B1 3/2004 Ellerbrock et al.
6,715,120 B1 3/2004 Hladik et al.
6,715,302 B2 4/2004 Ferragut, II
6,715,690 B2 4/2004 Hull et al.
6,717,513 B1 4/2004 Sandelman et al.
6,717,919 B1 4/2004 Ketcham et al.
6,718,384 B2 4/2004 Linzy
6,722,143 B2 4/2004 Moon et al.
6,725,180 B2 4/2004 Mayer et al.
6,725,398 B1 4/2004 Varma et al.
6,728,369 B2 4/2004 Burgess
6,732,191 B1 5/2004 Baker et al.
6,735,196 B1 5/2004 Manzardo
6,735,282 B2 5/2004 Matsushita et al.
6,735,965 B2 5/2004 Moon et al.
6,738,676 B2 5/2004 Hirayama
6,741,915 B2 5/2004 Poth
6,744,771 B1 6/2004 Barber et al.
6,745,106 B2 6/2004 Howard et al.
6,747,888 B2 6/2004 Klein
6,758,050 B2 7/2004 Jayanth et al.
6,758,051 B2 7/2004 Jayanth et al.
6,763,040 B1 7/2004 Hite et al.
6,763,272 B2 7/2004 Knepper
6,765,993 B2 7/2004 Cueman
6,768,732 B1 7/2004 Neuhaus
6,774,786 B1 8/2004 Havekost et al.
6,779,176 B1 8/2004 Chambers, II et al.
6,783,079 B2 8/2004 Carey et al.
6,789,739 B2 9/2004 Rosen
6,791,530 B2 9/2004 Vernier et al.
6,795,935 B1 9/2004 Unkle et al.
6,798,341 B1 9/2004 Eckel et al.
6,801,524 B2 10/2004 Eteminan
6,804,564 B2 10/2004 Crispin et al.
6,810,333 B2 10/2004 Adedeji et al.
6,814,299 B1 11/2004 Carey
6,814,660 B1 11/2004 Cavett
6,816,071 B2 11/2004 Conti
6,817,757 B1 11/2004 Wallace
6,819,802 B2 11/2004 Higgs et al.
6,822,202 B2 11/2004 Atlas
6,823,680 B2 11/2004 Jayanth
6,824,069 B2 11/2004 Rosen
6,826,454 B2 11/2004 Sulfstede
6,826,590 B1 11/2004 Glanzer et al.
6,832,118 B1 12/2004 Heberlein et al.
6,833,787 B1 12/2004 Levi
6,833,844 B1 12/2004 Shiota et al.
6,840,052 B2 1/2005 Smith et al.
6,842,117 B2 1/2005 Keown
6,842,808 B2 1/2005 Weigl et al.
6,845,918 B2 1/2005 Rotondo
6,850,992 B2 2/2005 Heinrich et al.
6,851,948 B2 2/2005 Dempsey et al.
6,853,291 B1 2/2005 Aisa
6,854,444 B2 2/2005 Plagge et al.
6,865,449 B2 3/2005 Dudley
6,865,596 B1 3/2005 Barber et al.
6,865,898 B2 3/2005 Yamanashi et al.
6,866,375 B2 3/2005 Leighton et al.
6,868,292 B2 3/2005 Ficco et al.
6,868,900 B2 3/2005 Dage et al.
6,874,693 B2 4/2005 Readio et al.
6,876,891 B1 4/2005 Schuler et al.
6,879,881 B1 4/2005 Attridge, Jr.
6,888,441 B2 5/2005 Carey
6,892,121 B2 5/2005 Schmidt
6,894,703 B2 5/2005 Vernier et al.
6,900,808 B2 5/2005 Lassiter et al.
6,901,316 B1 5/2005 Jensen et al.
6,901,439 B1 5/2005 Bonasia et al.
6,907,329 B2 6/2005 Junger et al.
6,909,948 B2 6/2005 Mollmann et al.
6,914,893 B2 7/2005 Petite
6,918,064 B2 7/2005 Mueller et al.
6,920,318 B2 7/2005 Brooking et al.
6,925,360 B2 8/2005 Yoon et al.
6,931,645 B2 8/2005 Murching et al.
6,938,106 B2 8/2005 Ellerbrock et al.
6,941,193 B2 9/2005 Frecska et al.
6,944,785 B2 9/2005 Gadir et al.
6,954,680 B2 10/2005 Kreidler et al.
6,955,060 B2 10/2005 Homan et al.
6,955,302 B2 10/2005 Erdman, Jr.
6,956,424 B2 10/2005 Hohnel
6,957,696 B1 10/2005 Krumnow
6,963,288 B1 11/2005 Sokol et al.
6,963,922 B2 11/2005 Papadopoulos et al.
6,965,802 B2 11/2005 Sexton
6,967,565 B2 11/2005 Lingemann
6,968,295 B1 11/2005 Carr
6,973,366 B2 12/2005 Komai
6,975,219 B2 12/2005 Eryurek et al.
6,975,913 B2 12/2005 Kreidler et al.
6,975,958 B2 12/2005 Bohrer et al.
6,980,796 B1 12/2005 Cuellar et al.
6,981,266 B1 12/2005 An et al.
6,983,271 B2 1/2006 Morrow et al.
6,983,889 B2 1/2006 Alles
6,988,011 B2 1/2006 Varma et al.
6,988,671 B2 1/2006 DeLuca
6,990,381 B2 1/2006 Nomura et al.
6,990,540 B2 1/2006 Dalakuras et al.
6,993,414 B2 1/2006 Shah
RE38,985 E 2/2006 Boatman et al.
6,994,620 B2 2/2006 Mills
6,999,473 B2 2/2006 Windecker
6,999,824 B2 2/2006 Glanzer et al.
7,000,849 B2 2/2006 Ashworth et al.
7,002,462 B2 2/2006 Welch
7,003,378 B2 2/2006 Poth
7,006,460 B1 2/2006 Vollmer et al.
7,006,881 B1 2/2006 Hoffberg et al.
7,013,239 B2 3/2006 Hedlund et al.
7,017,827 B2 3/2006 Shah et al.
7,020,798 B2 3/2006 Meng et al.
7,022,008 B1 4/2006 Crocker 7,024,282 B2 4/2006 Coogan et al.
7,024,283 B2 4/2006 Bicknell
7,025,281 B2 4/2006 DeLuca
7,027,808 B2 4/2006 Wesby
7,029,391 B2 4/2006 Nagaya et al.
7,031,880 B1 4/2006 Seem et al.
7,032,018 B2 4/2006 Lee et al.
7,035,719 B2 4/2006 Howard et al.
7,035,898 B1 4/2006 Baker
7,036,743 B2 5/2006 Shah
7,043,339 B2 5/2006 Maeda et al.
7,044,397 B2 5/2006 Bartlett et al.
7,047,092 B2 5/2006 Wimsatt
7,051,282 B2 5/2006 Marcjan
7,055,759 B2 6/2006 Wacker et al.
7,058,459 B2 6/2006 Weiberle et al.
7,058,477 B1 6/2006 Rosen
7,058,693 B1 6/2006 Baker, Jr.
7,058,737 B2 6/2006 Ellerbrock et al.
7,062,927 B2 6/2006 Kwon et al.
7,068,612 B2 6/2006 Berkcan et al.
7,076,962 B2 7/2006 He et al.
7,082,339 B2 7/2006 Murray et al.
7,082,352 B2 7/2006 Lim
7,083,109 B2 8/2006 Pouchak
7,085,626 B2 8/2006 Harrod et al.
7,085,814 B1 8/2006 Gandhi et al.
7,089,087 B2 8/2006 Dudley
7,089,088 B2 8/2006 Terry et al.
7,089,530 B1 8/2006 Dardinski et al.
7,092,768 B1 8/2006 Labuda
7,092,772 B2 8/2006 Murray et al.
7,092,794 B1 8/2006 Hill et al.
7,096,078 B2 8/2006 Burr et al.
7,096,285 B2 8/2006 Ellerbrock et al.
7,096,465 B1 8/2006 Dardinski et al.
7,099,965 B2 8/2006 Ellerbrock et al.
7,100,382 B2 9/2006 Butler et al.
7,103,000 B1 9/2006 Rode et al.
7,103,016 B1 9/2006 Duffy et al.
7,103,420 B2 9/2006 Brown et al.
7,110,835 B2 9/2006 Blevins et al.
7,114,088 B2 9/2006 Horbelt
7,114,554 B2 10/2006 Bergman et al.
7,117,050 B2 10/2006 Sasaki et al.
7,117,051 B2 10/2006 Landry et al.
7,117,395 B2 10/2006 Opaterny
7,120,036 B2 10/2006 Kyono
7,123,428 B2 10/2006 Yeo et al.
7,123,774 B2 10/2006 Dhavala et al.
7,127,305 B1 10/2006 Palmon
7,127,327 B1 10/2006 O'Donnell
7,130,409 B2 10/2006 Beyda
7,130,719 B2 10/2006 Ehlers et al.
7,133,407 B2 11/2006 Jinzaki et al.
7,133,748 B2 11/2006 Robinson
7,133,749 B2 11/2006 Goldberg et al.
7,135,982 B2 11/2006 Lee
7,139,550 B2 11/2006 Cuellar et al.
7,142,948 B2 11/2006 Metz
7,146,230 B2 12/2006 Glanzer et al.
7,146,231 B2 12/2006 Schleiss et al.
7,146,253 B2 12/2006 Hoog et al.
7,150,408 B2 12/2006 DeLuca
7,155,318 B2 12/2006 Sharma et al.
7,155,499 B2 12/2006 Soemo et al.
7,156,316 B2 1/2007 Kates
7,162,512 B1 1/2007 Amit et al.
7,162,883 B2 1/2007 Jayanth et al.
7,163,156 B2 1/2007 Kates
7,163,158 B2 1/2007 Rossi et al.
7,167,762 B2 1/2007 Glanzer et al.
7,168,627 B2 1/2007 Kates
7,171,579 B2 1/2007 Weigl et al.
7,172,132 B2 2/2007 Proffitt et al.
7,172,160 B2 2/2007 Piel et al.
7,174,239 B2 2/2007 Butler et al.
7,174,728 B2 2/2007 Jayanth
7,175,086 B2 2/2007 Gascoyne et al.
7,175,098 B2 2/2007 DeLuca
7,177,926 B2 2/2007 Kramer
7,181,317 B2 2/2007 Amundson et al.
7,185,262 B2 2/2007 Barthel et al.
7,186,290 B2 3/2007 Sheehan et al.
7,187,354 B2 3/2007 Min et al.
7,187,986 B2 3/2007 Johnson et al.
7,188,002 B2 3/2007 Chapman, Jr. et al.
7,188,207 B2 3/2007 Mitter
7,188,482 B2 3/2007 Sadegh et al.
7,188,779 B2 3/2007 Alles
7,191,028 B2 3/2007 Nomura et al.
7,194,663 B2 3/2007 Fletcher et al.
7,195,211 B2 3/2007 Kande et al.
7,197,717 B2 3/2007 Anderson et al.
7,200,450 B2 4/2007 Boyer et al.
7,203,165 B1 4/2007 Kowalewski
7,203,575 B2 4/2007 Maturana et al.
7,203,776 B2 4/2007 Junger et al.
7,206,646 B2 4/2007 Nixon et al.
7,206,647 B2 4/2007 Kumar
7,209,485 B2 4/2007 Guse
7,209,748 B2 4/2007 Wong et al.
7,212,825 B2 5/2007 Wong et al
7,213,044 B2 5/2007 Tjong et al.
7,216,016 B2 5/2007 Van Ostrand et al.
7,216,017 B2 5/2007 Kwon et al.
7,216,497 B2 5/2007 Hull et al.
7,218,589 B2 5/2007 Wisnudel et al.
7,218,996 B1 5/2007 Beitelmal et al.
7,219,141 B2 5/2007 Bonasia et al.
7,222,111 B1 5/2007 Budke, Jr.
7,222,152 B1 5/2007 Thompson et al.
7,222,493 B2 5/2007 Jayanth et al.
7,222,494 B2 5/2007 Peterson et al.
7,224,366 B2 5/2007 Kessler et al.
7,225,054 B2 5/2007 Amundson et al.
7,225,356 B2 5/2007 Monitzer
7,228,187 B2 6/2007 Ticky et al.
7,232,058 B2 6/2007 Lee
7,233,229 B2 6/2007 Stroupe et al.
7,239,623 B2 7/2007 Burghardt et al.
7,242,988 B1 7/2007 Hoffberg et al.
7,243,004 B2 7/2007 Shah et al.
7,244,294 B2 7/2007 Kates
7,246,753 B2 7/2007 Hull et al.
7,248,576 B2 7/2007 Hoffmann
7,251,534 B2 7/2007 Walls et al.
7,257,813 B1 8/2007 Mayer et al.
7,259,666 B1 8/2007 Hermsmeyer et al.
7,260,084 B2 8/2007 Saller
7,260,451 B2 8/2007 Takai et al.
7,260,609 B2 8/2007 Fuehrer et al.
7,260,948 B2 8/2007 Jayanth et al.
7,261,241 B2 8/2007 Eoga
7,261,243 B2 8/2007 Butler et al.
7,261,762 B2 8/2007 Kang et al.
7,266,775 B2 9/2007 Patitucci
7,266,960 B2 9/2007 Shah
7,269,962 B2 9/2007 Bachmann
7,272,154 B2 9/2007 Loebig
7,272,452 B2 9/2007 Coogan et al.
7,272,457 B2 9/2007 Glanzer et al.
7,274,972 B2 9/2007 Amundson et al.
7,274,973 B2 9/2007 Nichols et al.
7,277,280 B2 10/2007 Peng
7,277,970 B2 10/2007 Ellerbrock et al.
7,278,103 B1 10/2007 Clark et al.
7,281,697 B2 10/2007 Reggiani
7,287,062 B2 10/2007 Im et al.
7,287,708 B2 10/2007 Lucas et al.
7,287,709 B2 10/2007 Proffitt et al.
7,289,458 B2 10/2007 Gila et al.
7,292,900 B2 11/2007 Kreidler et al.
7,293,422 B2 11/2007 Parachini et al.
7,295,099 B2 11/2007 Lee et al.
7,296,426 B2 11/2007 Butler et al.
7,299,279 B2 11/2007 Sadaghiany
7,299,996 B2 11/2007 Garrett et al.

7,301,699 B2 11/2007 Kanamori et al.
7,302,642 B2 11/2007 Smith et al.
7,305,495 B2 12/2007 Carter
7,306,165 B2 12/2007 Shah
7,310,559 B2 12/2007 Walko, Jr.
7,313,465 B1 12/2007 O'Donnell
7,313,716 B2 12/2007 Weigl et al.
7,313,923 B2 1/2008 Jayanth et al.
7,315,768 B2 1/2008 Dang et al.
7,317,970 B2 1/2008 Pienta et al.
7,318,089 B1 1/2008 Stachura et al.
7,320,110 B2 1/2008 Shah
7,324,874 B2 1/2008 Jung
7,327,376 B2 2/2008 Shen et al.
7,327,815 B1 2/2008 Jurisch
7,330,512 B2 2/2008 Frank et al.
7,331,191 B2 2/2008 He et al.
7,334,161 B2 2/2008 Williams et al.
7,336,650 B2 2/2008 Franz et al.
7,337,369 B2 2/2008 Barthel et al.
7,337,619 B2 3/2008 Hsieh et al.
7,343,226 B2 3/2008 Ehlers et al.
7,346,404 B2 3/2008 Eryurek et al.
7,346,433 B2 3/2008 Budike, Jr.
7,346,835 B1 3/2008 Lobinger et al.
7,349,761 B1 3/2008 Cruse
7,354,005 B2 4/2008 Carey et al.
7,356,050 B2 4/2008 Reindl et al.
7,359,335 B2 4/2008 Knop et al.
7,359,345 B2 4/2008 Chang et al.
7,360,002 B2 4/2008 Brueckner et al.
7,360,370 B2 4/2008 Shah et al.
7,360,717 B2 4/2008 Shah
7,364,093 B2 4/2008 Garozzo
7,365,812 B2 4/2008 Lee
7,366,498 B2 4/2008 Ko et al.
7,366,944 B2 4/2008 Oshins et al.
7,370,074 B2 5/2008 Alexander et al.
7,377,450 B2 5/2008 Van Ostrand et al.
7,379,791 B2 5/2008 Tamarkin et al.
7,379,997 B2 5/2008 Ehlers et al.
7,383,158 B2 6/2008 Krocker et al.
7,389,150 B2 6/2008 Inoue et al.
7,389,204 B2 6/2008 Eryurek et al.
RE40,437 E 7/2008 Rosen et al.
7,392,661 B2 7/2008 Alles
7,395,122 B2 7/2008 Kreidler et al.
7,395,137 B2 7/2008 Robinson
7,403,128 B2 7/2008 Scuka et al.
7,412,839 B2 8/2008 Jayanth
7,412,842 B2 8/2008 Pham
7,418,428 B2 8/2008 Ehlers et al.
7,424,345 B2 9/2008 Norbeck
D578,026 S 10/2008 Roher et al.
7,433,740 B2 10/2008 Hesse et al.
7,434,744 B2 10/2008 Garozzo et al.
7,436,292 B2 10/2008 Rourke et al.
7,436,293 B2 10/2008 Rourke et al.
7,436,296 B2 10/2008 Rourke et al.
7,436,400 B2 10/2008 Cheng
7,437,198 B2 10/2008 Iwaki
7,439,862 B2 10/2008 Quan
7,441,094 B2 10/2008 Stephens
7,446,660 B2 11/2008 Posamentier
7,448,435 B2 11/2008 Garozzo
7,451,937 B2 11/2008 Flood et al.
7,454,269 B1 11/2008 Dushane et al.
7,455,240 B2 11/2008 Chapman, Jr. et al.
7,457,853 B1 11/2008 Chari et al.
7,460,933 B2 12/2008 Chapman, Jr. et al.
7,476,988 B2 1/2009 Mulhouse et al.
7,516,106 B2 4/2009 Ehlers et al.
7,526,364 B2 4/2009 Rule et al.
7,567,844 B2 7/2009 Thomas et al.
7,571,195 B2 8/2009 Billingsley et al.
7,571,355 B2 8/2009 Shabalin
7,574,871 B2 8/2009 Bloemer et al.
7,584,897 B2 9/2009 Schultz et al.
7,587,459 B2 9/2009 Wewalaarachchi
7,593,124 B1 9/2009 Sheng et al.
7,593,787 B2 9/2009 Feingold et al.
7,604,046 B2 10/2009 Bergman et al.
7,624,931 B2 12/2009 Chapman et al.
7,641,126 B2 1/2010 Schultz et al.
7,650,323 B2 1/2010 Hesse et al.
D610,475 S 2/2010 Beers et al.
7,693,583 B2 4/2010 Wolff et al.
7,693,591 B2 4/2010 Hoglund et al.
7,706,923 B2 4/2010 Amundson et al.
7,730,223 B1 6/2010 Bavor et al.
7,734,572 B2 6/2010 Wiemeyer et al.
7,743,124 B2 6/2010 Holdaway et al.
7,747,757 B2 6/2010 Garglulo et al.
7,752,289 B2 7/2010 Kikkawa et al.
7,761,563 B2 7/2010 Shike et al.
7,774,102 B2 8/2010 Butler et al.
7,797,349 B2 9/2010 Kosaka
7,809,472 B1 10/2010 Silva et al.
7,827,963 B2 11/2010 Li et al.
7,847,790 B2 12/2010 Bewley et al.
7,861,941 B2 1/2011 Schultz et al.
7,870,080 B2 1/2011 Budike, Jr.
7,886,166 B2 2/2011 Shnekendorf et al.
7,904,209 B2 3/2011 Podgorny et al.
7,934,504 B2 5/2011 Lowe et al.
7,949,615 B2 5/2011 Ehlers et al.
7,963,454 B2 6/2011 Sullivan et al.
D642,081 S 7/2011 Kashimoto
7,979,164 B2 7/2011 Garozzo et al.
8,005,576 B2 8/2011 Rodgers
8,024,054 B2 9/2011 Mairs et al.
8,032,254 B2 10/2011 Amundson et al.
8,042,049 B2 10/2011 Killian et al.
D648,641 S 11/2011 Wallaert
D648,642 S 11/2011 Wallaert
8,050,801 B2 11/2011 Richards et al.
8,082,068 B2 12/2011 Rodgers
8,083,154 B2 12/2011 Schultz et al.
8,087,593 B2 1/2012 Leen
8,091,796 B2 1/2012 Amundson et al.
8,099,178 B2 1/2012 Mairs et al.
8,103,390 B2 1/2012 Rodgers
8,112,181 B2 2/2012 Remsburg
8,116,917 B2 2/2012 Rodgers
8,122,110 B1 2/2012 Wilbur et al.
8,127,060 B2 2/2012 Doll et al.
8,167,216 B2 5/2012 Schultz et al.
8,183,995 B2 5/2012 Wang et al.
8,219,249 B2 7/2012 Harrod et al.
8,224,491 B2 7/2012 Koster et al.
8,239,066 B2 8/2012 Jennings et al.
8,239,073 B2 8/2012 Fausak et al.
8,244,383 B2 8/2012 Bergman et al.
8,255,090 B2 8/2012 Frader-Thompson
2001/0025349 A1 9/2001 Sharood et al.
2001/0034586 A1 10/2001 Ewert et al.
2001/0048376 A1 12/2001 Maeda et al.
2001/0055311 A1 12/2001 Trachewsky et al.
2002/0002425 A1 1/2002 Dossey et al.
2002/0013897 A1 1/2002 McTernan et al.
2002/0016639 A1 2/2002 Smith et al.
2002/0022894 A1 2/2002 Eryurek et al.
2002/0026476 A1 2/2002 Miyazaki et al.
2002/0033252 A1 3/2002 Sasao et al.
2002/0048194 A1 4/2002 Klein
2002/0072814 A1 6/2002 Schuler et al.
2002/0091784 A1 7/2002 Baker et al.
2002/0104323 A1 8/2002 Rash et al.
2002/0116550 A1 8/2002 Hansen
2002/0123896 A1 9/2002 Diez et al.
2002/0124211 A1 9/2002 Gray et al.
2002/0143523 A1 10/2002 Balaji et al.
2002/0152298 A1* 10/2002 Kikta et al. ..... 709/223
2002/0157054 A1 10/2002 Shin et al.
2002/0163427 A1 11/2002 Eryurek et al.
2002/0178288 A1 11/2002 McLeod
2002/0190242 A1 12/2002 Iillie et al.
2002/0191026 A1 12/2002 Rodden et al.

2002/0191603 A1 12/2002 Shin et al.
2003/0058863 A1 3/2003 Oost
2003/0061340 A1 3/2003 Sun et al.
2003/0078677 A1 4/2003 Hull et al.
2003/0088338 A1 5/2003 Phillips et al.
2003/0097482 A1 5/2003 DeHart et al.
2003/0108064 A1 6/2003 Bilke et al.
2003/0115177 A1 6/2003 Takanabe et al.
2003/0116637 A1 6/2003 Ellingham
2003/0154355 A1 8/2003 Fernandez
2003/0206100 A1 11/2003 Richman et al.
2003/0229784 A1 12/2003 Cuellar et al.
2004/0001478 A1 1/2004 Wong
2004/0003051 A1 1/2004 Krzyzanowski et al.
2004/0003415 A1 1/2004 Ng
2004/0025089 A1 2/2004 Haswarey et al.
2004/0039478 A1 2/2004 Kiesel et al.
2004/0059815 A1 3/2004 Buckingham et al.
2004/0066788 A1 4/2004 Lin et al.
2004/0088069 A1 5/2004 Singh
2004/0095237 A1 5/2004 Chen et al.
2004/0104942 A1 6/2004 Weigel
2004/0107717 A1 6/2004 Yoon et al.
2004/0111186 A1 6/2004 Rossi et al.
2004/0111254 A1 6/2004 Gogel et al.
2004/0117330 A1 6/2004 Ehlers et al.
2004/0133314 A1 7/2004 Ehlers et al.
2004/0133704 A1 7/2004 Krzyzanowski
2004/0138981 A1 7/2004 Ehlers et al.
2004/0139038 A1 7/2004 Ehlers et al.
2004/0143360 A1 7/2004 Kiesel et al.
2004/0146008 A1 7/2004 Conradt et al.
2004/0148482 A1 7/2004 Grundy et al.
2004/0156360 A1 8/2004 Sexton et al.
2004/0159112 A1 8/2004 Jayanth et al.
2004/0189590 A1 9/2004 Mehaffey et al.
2004/0204775 A1 10/2004 Keyes et al.
2004/0205781 A1 10/2004 Hill et al.
2004/0206096 A1 10/2004 Jayanth
2004/0210348 A1 10/2004 Imhof et al.
2004/0218591 A1* 11/2004 Ogawa et al. ..... 370/364
2004/0222307 A1 11/2004 DeLuca
2004/0236471 A1 11/2004 Poth
2004/0245352 A1 12/2004 Smith et al.
2004/0260427 A1 12/2004 Wimsatt
2004/0266491 A1 12/2004 Howard et al.
2004/0267385 A1 12/2004 Lingemann
2004/0267395 A1 12/2004 Discenzo et al.
2004/0267790 A1 12/2004 Pak et al.
2005/0005249 A1 1/2005 Hill et al.
2005/0007249 A1 1/2005 Eryurek et al.
2005/0010759 A1 1/2005 Wakiyama
2005/0033707 A1 2/2005 Ehlers et al.
2005/0034023 A1 2/2005 Maturana et al.
2005/0040247 A1 2/2005 Pouchak
2005/0040250 A1 2/2005 Wruck
2005/0041033 A1 2/2005 Hilts et al.
2005/0041633 A1 2/2005 Roeser et al.
2005/0046584 A1 3/2005 Breed
2005/0051168 A1 3/2005 DeVries et al.
2005/0054381 A1 3/2005 Lee et al.
2005/0055427 A1 3/2005 Frutiger et al.
2005/0068978 A1 3/2005 Sexton et al.
2005/0073789 A1 4/2005 Tanis
2005/0076150 A1 4/2005 Lee et al.
2005/0080879 A1 4/2005 Kim et al.
2005/0081156 A1 4/2005 Clark et al.
2005/0081157 A1 4/2005 Clark et al.
2005/0090915 A1 4/2005 Gelwitz
2005/0096872 A1 5/2005 Blevins et al.
2005/0097478 A1 5/2005 Killian et al.
2005/0103874 A1 5/2005 Erdman
2005/0109048 A1 5/2005 Lee
2005/0116023 A1 6/2005 Amundson et al.
2005/0118996 A1 6/2005 Lee et al.
2005/0119765 A1 6/2005 Bergman
2005/0119766 A1 6/2005 Amundson et al.
2005/0119771 A1 6/2005 Amundson et al.
2005/0119793 A1 6/2005 Amundson et al.
2005/0119794 A1 6/2005 Amundson et al.
2005/0120012 A1 6/2005 Poth et al.
2005/0125495 A1 6/2005 Tjong et al.
2005/0143138 A1 6/2005 Lee et al.
2005/0145705 A1 7/2005 Shah et al.
2005/0150967 A1 7/2005 Chapman, Jr. et al.
2005/0154494 A1 7/2005 Ahmed
2005/0159848 A1 7/2005 Shah et al.
2005/0159924 A1 7/2005 Shah et al.
2005/0161517 A1 7/2005 Helt et al.
2005/0166610 A1 8/2005 Jayanth
2005/0176410 A1 8/2005 Brooking et al.
2005/0182498 A1 8/2005 Landou et al.
2005/0192727 A1 9/2005 Shostak et al.
2005/0193155 A1 9/2005 Fujita
2005/0198040 A1 9/2005 Cohen et al.
2005/0223339 A1 10/2005 Lee
2005/0229610 A1 10/2005 Park et al.
2005/0235661 A1 10/2005 Pham
2005/0235662 A1 10/2005 Pham
2005/0235663 A1 10/2005 Pham
2005/0240312 A1 10/2005 Terry et al.
2005/0252673 A1 11/2005 Kregle et al.
2005/0256591 A1 11/2005 Rule et al.
2005/0256935 A1 11/2005 Overstreet et al.
2005/0258257 A1 11/2005 Thurman et al.
2005/0270151 A1 12/2005 Winick
2005/0278071 A1 12/2005 Durham, III
2005/0280364 A1 12/2005 Omura et al.
2005/0281368 A1 12/2005 Droba et al.
2005/0288823 A1 12/2005 Hesse et al.
2006/0006244 A1 1/2006 Morrow et al.
2006/0009861 A1 1/2006 Bonasla
2006/0009863 A1 1/2006 Lingemann
2006/0021358 A1 2/2006 Nallapa
2006/0021359 A1 2/2006 Hur et al.
2006/0030954 A1 2/2006 Bergman et al.
2006/0036350 A1 2/2006 Bohrer et al.
2006/0036952 A1 2/2006 Yang
2006/0041898 A1 2/2006 Potyrailo et al.
2006/0045107 A1 3/2006 Kucenas et al.
2006/0048064 A1 3/2006 Vronay
2006/0058924 A1 3/2006 Shah
2006/0063523 A1 3/2006 McFarland et al.
2006/0090142 A1 4/2006 Glasgow et al.
2006/0090483 A1 5/2006 Kim et al.
2006/0091227 A1 5/2006 Attridge, Jr.
2006/0092977 A1 5/2006 Bai et al.
2006/0106791 A1 5/2006 Morrow et al.
2006/0108432 A1 5/2006 Mattheis
2006/0111816 A1 5/2006 Spalink et al.
2006/0130497 A1 6/2006 Kang et al.
2006/0144055 A1 7/2006 Ahn
2006/0144232 A1 7/2006 Kang et al.
2006/0149414 A1 7/2006 Archacki, Jr. et al.
2006/0150027 A1 7/2006 Paden
2006/0153247 A1 7/2006 Stumer
2006/0155398 A1 7/2006 Hoffberg et al.
2006/0158051 A1 7/2006 Bartlett et al.
2006/0159007 A1* 7/2006 Frutiger et al. ..... 370/216
2006/0168522 A1 7/2006 Bala
2006/0185818 A1 8/2006 Garozzo
2006/0186214 A1 8/2006 Simon et al.
2006/0190138 A1 8/2006 Stone et al.
2006/0192021 A1 8/2006 Schultz et al.
2006/0192022 A1 8/2006 Barton et al.
2006/0196953 A1 9/2006 Simon et al.
2006/0200253 A1 9/2006 Hoffberg et al.
2006/0200258 A1 9/2006 Hoffberg et al.
2006/0200259 A1 9/2006 Hoffberg et al.
2006/0200260 A1 9/2006 Hoffberg et al.
2006/0202978 A1 9/2006 Lee et al.
2006/0206220 A1 9/2006 Amundson
2006/0209208 A1 9/2006 Kim et al.
2006/0212194 A1 9/2006 Breed
2006/0219799 A1 10/2006 Schultz et al.
2006/0229090 A1 10/2006 LaDue
2006/0235548 A1 10/2006 Gaudette
2006/0236351 A1 10/2006 Ellerbrock et al.

2006/0239296 A1 10/2006 Jinzaki et al.
2006/0248233 A1 11/2006 Park et al.
2006/0250578 A1 11/2006 Pohl et al.
2006/0250979 A1 11/2006 Gauweiler et al.
2006/0267756 A1 11/2006 Kates
2006/0276917 A1 12/2006 Li et al.
2007/0005191 A1 1/2007 Sloup et al.
2007/0008116 A1 1/2007 Bergman et al.
2007/0012052 A1 1/2007 Butler et al.
2007/0013534 A1 1/2007 DiMaggio
2007/0014233 A1 1/2007 Oguro et al.
2007/0016311 A1 1/2007 Bergman et al.
2007/0016476 A1 1/2007 Hoffberg et al.
2007/0019683 A1 1/2007 Kryzyanowski
2007/0025368 A1 2/2007 Ha et al.
2007/0032909 A1 2/2007 Tolbert, Jr. et al.
2007/0033310 A1 2/2007 Kweon
2007/0035255 A1 2/2007 Shuster et al.
2007/0040040 A1 2/2007 Mueller
2007/0043477 A1 2/2007 Ehlers et al.
2007/0043478 A1 2/2007 Ehlers et al.
2007/0045429 A1 3/2007 Chapman et al.
2007/0045431 A1 3/2007 Chapman et al.
2007/0045442 A1 3/2007 Chapman et al.
2007/0051818 A1 3/2007 Atlas
2007/0053513 A1 3/2007 Hoffberg
2007/0055407 A1 3/2007 Goldberg et al.
2007/0055757 A1 3/2007 Mairs et al.
2007/0067062 A1 3/2007 Mairs et al.
2007/0067496 A1 3/2007 Deiretsbacher et al.
2007/0073973 A1 3/2007 Hazay
2007/0080235 A1 4/2007 Fulton, Jr.
2007/0083721 A1 4/2007 Grinspan
2007/0084937 A1 4/2007 Ahmed
2007/0088883 A1 4/2007 Wakabayashi
2007/0089090 A1 4/2007 Riedl et al.
2007/0090199 A1 4/2007 Hull et al.
2007/0093226 A1 4/2007 Foltyn et al.
2007/0097993 A1 5/2007 Bojahra et al.
2007/0102149 A1 5/2007 Kates
2007/0109114 A1 5/2007 Farley et al.
2007/0109975 A1 5/2007 Reckamp et al.
2007/0113247 A1 5/2007 Kwak
2007/0114291 A1 5/2007 Pouchak
2007/0119957 A1 5/2007 Kates
2007/0119958 A1 5/2007 Kates
2007/0129820 A1 6/2007 Glanzer et al.
2007/0129825 A1 6/2007 Kargenian
2007/0129826 A1 6/2007 Kreidler et al.
2007/0129917 A1 6/2007 Blevins et al.
2007/0130834 A1 6/2007 Kande et al.
2007/0130969 A1 6/2007 Peterson et al.
2007/0131784 A1 6/2007 Garozzo et al.
2007/0135692 A1 6/2007 Hwang et al.
2007/0135946 A1 6/2007 Sugiyama et al.
2007/0136669 A1 6/2007 Kwon et al.
2007/0136687 A1 6/2007 Pak
2007/0138307 A1 6/2007 Khoo
2007/0138308 A1 6/2007 Schultz et al.
2007/0143704 A1 6/2007 Laird-McConnell
2007/0143707 A1 6/2007 Yun et al.
2007/0157016 A1 7/2007 Dayan et al.
2007/0158442 A1 7/2007 Chapman, Jr. et al.
2007/0168887 A1 7/2007 Lee
2007/0177505 A1 8/2007 Charrua et al.
2007/0191024 A1 8/2007 Kim et al.
2007/0192731 A1 8/2007 Townsend et al.
2007/0204637 A1 9/2007 Fujii et al.
2007/0205297 A1 9/2007 Finkam et al.
2007/0205916 A1 9/2007 Blom et al.
2007/0208461 A1 9/2007 Chase
2007/0208549 A1 9/2007 Blevins et al.
2007/0213853 A1 9/2007 Glanzer et al.
2007/0219645 A1 9/2007 Thomas et al.
2007/0220301 A1 9/2007 Brundridge et al.
2007/0220907 A1 9/2007 Ehlers
2007/0223500 A1 9/2007 Lee et al.
2007/0225868 A1 9/2007 Terlson et al.
2007/0225869 A1 9/2007 Amundson et al.
2007/0233323 A1 10/2007 Wiemeyer et al.
2007/0236156 A1 10/2007 Lys et al.
2007/0237032 A1 10/2007 Rhee et al.
2007/0238413 A1 10/2007 Coutts
2007/0239658 A1 10/2007 Cunningham et al.
2007/0240226 A1 10/2007 Song et al.
2007/0241203 A1 10/2007 Wagner et al.
2007/0242058 A1 10/2007 Yamada
2007/0245306 A1 10/2007 Dameshek et al.
2007/0257120 A1 11/2007 Chapman, Jr. et al.
2007/0260782 A1 11/2007 Shaikli
2007/0260978 A1 11/2007 Oh et al.
2007/0266329 A1 11/2007 Gaudette
2007/0271521 A1 11/2007 Harriger et al.
2007/0274093 A1 11/2007 Haim et al.
2007/0277013 A1 11/2007 Rexha et al.
2007/0278320 A1 12/2007 Lunacek et al.
2007/0284452 A1 12/2007 Butler et al.
2007/0299857 A1 12/2007 Gwozdz et al.
2007/0300064 A1 12/2007 Isaacs et al.
2008/0003845 A1 1/2008 Hong et al.
2008/0004727 A1 1/2008 Glanzer et al.
2008/0005428 A1 1/2008 Maul et al.
2008/0006709 A1 1/2008 Ashworth et al.
2008/0013259 A1 1/2008 Barton et al.
2008/0029610 A1* 2/2008 Nichols ..... 236/1 C
2008/0031147 A1 2/2008 Fieremans et al.
2008/0040351 A1 2/2008 Jin et al.
2008/0048045 A1 2/2008 Butler et al.
2008/0048046 A1 2/2008 Wagner et al.
2008/0054082 A1 3/2008 Evans et al.
2008/0055190 A1 3/2008 Lee
2008/0056722 A1 3/2008 Hendrix et al.
2008/0057872 A1 3/2008 McFarland et al.
2008/0057931 A1 3/2008 Nass et al.
2008/0058996 A1 3/2008 Sachdev et al.
2008/0059682 A1 3/2008 Cooley et al.
2008/0062892 A1 3/2008 Dodgen et al.
2008/0063006 A1 3/2008 Nichols
2008/0065926 A1 3/2008 Poth et al.
2008/0072704 A1 3/2008 Clark et al.
2008/0073440 A1 3/2008 Butler et al.
2008/0077884 A1 3/2008 Patitucci
2008/0077886 A1 3/2008 Eichner
2008/0082767 A1 4/2008 Nulkar et al.
2008/0083009 A1 4/2008 Kaler et al.
2008/0083834 A1 4/2008 Krebs et al.
2008/0097651 A1 4/2008 Shah et al.
2008/0104189 A1 5/2008 Baker et al.
2008/0114500 A1 5/2008 Hull et al.
2008/0120335 A1 5/2008 Dolgoff
2008/0121729 A1 5/2008 Gray
2008/0128523 A1 6/2008 Hoglund et al.
2008/0129475 A1 6/2008 Breed et al.
2008/0133033 A1 6/2008 Wolff et al.
2008/0133060 A1 6/2008 Hoglund et al.
2008/0133061 A1 6/2008 Hoglund et al.
2008/0134087 A1 6/2008 Hoglund et al.
2008/0134098 A1 6/2008 Hoglund et al.
2008/0144302 A1 6/2008 Rosenblatt
2008/0148098 A1 6/2008 Chen
2008/0161977 A1 7/2008 Takach et al.
2008/0161978 A1 7/2008 Shah
2008/0168255 A1 7/2008 Abou-Emara et al.
2008/0168356 A1 7/2008 Eryurek et al.
2008/0183335 A1 7/2008 Poth et al.
2008/0184059 A1 7/2008 Chen
2008/0185976 A1 8/2008 Dickey et al.
2008/0186160 A1 8/2008 Kim et al.
2008/0192649 A1 8/2008 Pyeon et al.
2008/0195254 A1 8/2008 Jung et al.
2008/0195581 A1 8/2008 Ashmore et al.
2008/0195687 A1 8/2008 Jung et al.
2008/0198036 A1 8/2008 Songkakul et al.
2008/0215987 A1 9/2008 Alexander et al.
2008/0217418 A1 9/2008 Helt et al.
2008/0217419 A1 9/2008 Ehlers et al.
2008/0223944 A1 9/2008 Helt et al.
2008/0235611 A1 9/2008 Fraley et al.

2008/0256475 A1 10/2008 Amundson et al.
2008/0264085 A1 10/2008 Perry et al.
2008/0272934 A1 11/2008 Wang et al.
2008/0281472 A1 11/2008 Podgorny et al.
2008/0294274 A1 11/2008 Laberge et al.
2008/0294932 A1 11/2008 Oshins et al.
2009/0001180 A1 1/2009 Siddaramanna et al.
2009/0001182 A1 1/2009 Siddaramanna et al.
2009/0049847 A1 2/2009 Butler et al.
2009/0052105 A1 2/2009 Soleimani et al.
2009/0057424 A1 3/2009 Sullivan et al.
2009/0057425 A1 3/2009 Sullivan et al.
2009/0065597 A1 3/2009 Garozzo et al.
2009/0094506 A1 4/2009 Lakkis
2009/0105846 A1 4/2009 Hesse et al.
2009/0113037 A1 4/2009 Pouchak
2009/0119092 A1 5/2009 Balasubramanyan
2009/0132091 A1 5/2009 Chambers et al.
2009/0140056 A1 6/2009 Leen
2009/0140057 A1 6/2009 Leen
2009/0140058 A1 6/2009 Koster et al.
2009/0140061 A1 6/2009 Schultz et al.
2009/0140062 A1 6/2009 Amundson et al.
2009/0140063 A1 6/2009 Koster et al.
2009/0140064 A1 6/2009 Schultz et al.
2009/0143879 A1 6/2009 Amundson et al.
2009/0143880 A1 6/2009 Amundson et al.
2009/0143916 A1 6/2009 Boll et al.
2009/0143918 A1 6/2009 Amundson et al.
2009/0157529 A1 6/2009 Ehlers et al.
2009/0195349 A1 8/2009 Frader-Thompson
2009/0198810 A1 8/2009 Bayer et al.
2009/0245278 A1 10/2009 Kee
2009/0257431 A1 10/2009 Ramanathan et al.
2009/0259785 A1 10/2009 Perry et al.
2009/0261174 A1 10/2009 Butler et al.
2009/0261767 A1 10/2009 Butler et al.
2009/0266904 A1 10/2009 Cohen
2009/0267540 A1 10/2009 Chemel et al.
2009/0271336 A1 10/2009 Franks
2009/0287736 A1 11/2009 Shike et al.
2010/0011437 A1 1/2010 Courtney
2010/0023865 A1 1/2010 Fulker et al.
2010/0050075 A1 2/2010 Thorson et al.
2010/0050108 A1 2/2010 Mirza
2010/0070086 A1 3/2010 Harrod et al.
2010/0070089 A1 3/2010 Harrod et al.
2010/0070093 A1 3/2010 Harrod et al.
2010/0070907 A1 3/2010 Harrod et al.
2010/0073159 A1 3/2010 Schmickley et al.
2010/0076605 A1 3/2010 Harrod et al.
2010/0100253 A1 4/2010 Fausak et al.
2010/0101854 A1 4/2010 Wallaert et al.
2010/0102136 A1 4/2010 Hadzidedic et al.
2010/0102948 A1 4/2010 Grohman et al.
2010/0102973 A1 4/2010 Grohman et al.
2010/0106305 A1 4/2010 Pavlak et al.
2010/0106307 A1 4/2010 Grohman et al.
2010/0106308 A1 4/2010 Filbeck et al.
2010/0106309 A1 4/2010 Grohman et al.
2010/0106310 A1 4/2010 Grohman
2010/0106311 A1 4/2010 Wallaert
2010/0106312 A1 4/2010 Grohman et al.
2010/0106313 A1 4/2010 Grohman et al.
2010/0106314 A1 4/2010 Grohman et al.
2010/0106315 A1 4/2010 Grohman
2010/0106316 A1 4/2010 Curry et al.
2010/0106317 A1 4/2010 Grohman et al.
2010/0106318 A1 4/2010 Grohman et al.
2010/0106319 A1 4/2010 Grohman et al.
2010/0106320 A1 4/2010 Grohman et al.
2010/0106321 A1 4/2010 Hadzidedic
2010/0106322 A1 4/2010 Grohman
2010/0106323 A1 4/2010 Wallaert
2010/0106324 A1 4/2010 Grohman
2010/0106325 A1 4/2010 Grohman
2010/0106326 A1 4/2010 Grohman
2010/0106327 A1 4/2010 Grohman et al.
2010/0106329 A1 4/2010 Grohman
2010/0106330 A1 4/2010 Grohman
2010/0106333 A1 4/2010 Grohman et al.
2010/0106334 A1 4/2010 Grohman et al.
2010/0106787 A1 4/2010 Grohman
2010/0106809 A1 4/2010 Grohman
2010/0106810 A1 4/2010 Grohman
2010/0106814 A1 4/2010 Hadzidedic et al.
2010/0106815 A1 4/2010 Grohman et al.
2010/0106925 A1 4/2010 Grohman et al.
2010/0106957 A1 4/2010 Grohman et al.
2010/0107007 A1 4/2010 Grohman et al.
2010/0107070 A1 4/2010 Devineni et al.
2010/0107071 A1 4/2010 Pavlak et al.
2010/0107072 A1 4/2010 Mirza et al.
2010/0107073 A1 4/2010 Wallaert
2010/0107074 A1 4/2010 Pavlak et al.
2010/0107076 A1 4/2010 Grohman
2010/0107083 A1 4/2010 Grohman
2010/0107103 A1 4/2010 Wallaert
2010/0107109 A1 4/2010 Filbeck et al.
2010/0107110 A1 4/2010 Mirza
2010/0107111 A1 4/2010 Mirza
2010/0107112 A1 4/2010 Jennings et al.
2010/0107232 A1 4/2010 Grohman et al.
2010/0115364 A1 5/2010 Grohman
2010/0142526 A1 6/2010 Wong
2010/0145629 A1 6/2010 Botich et al.
2010/0168924 A1 7/2010 Tessier et al.
2010/0169419 A1 7/2010 DeVilbiss et al.
2010/0179696 A1 7/2010 Grohman et al.
2010/0211546 A1 8/2010 Grohman et al.
2010/0241245 A1 9/2010 Wiemeyer et al.
2010/0259931 A1 10/2010 Chemel et al.
2010/0264846 A1 10/2010 Chemel et al.
2010/0270933 A1 10/2010 Chemel et al.
2010/0295474 A1 11/2010 Chemel et al.
2010/0295475 A1 11/2010 Chemel et al.
2010/0295482 A1 11/2010 Chemel et al.
2010/0301768 A1 12/2010 Chemel et al.
2010/0301769 A1 12/2010 Chemel et al.
2010/0301770 A1 12/2010 Chemel et al.
2010/0301771 A1 12/2010 Chemel et al.
2010/0301772 A1 12/2010 Hahnlen et al.
2010/0301773 A1 12/2010 Chemel et al.
2010/0301774 A1 12/2010 Chemel et al.
2010/0305761 A1 12/2010 Remsburg
2010/0314458 A1 12/2010 Votaw et al.
2010/0319362 A1 12/2010 Hisaoka
2011/0001436 A1 1/2011 Chemel et al.
2011/0001438 A1 1/2011 Chemel et al.
2011/0004823 A1 1/2011 Wallaert
2011/0004824 A1 1/2011 Thorson et al.
2011/0007016 A1 1/2011 Mirza et al.
2011/0007017 A1 1/2011 Wallaert
2011/0010620 A1 1/2011 Mirza et al.
2011/0010621 A1 1/2011 Wallaert
2011/0010652 A1 1/2011 Wallaert
2011/0010653 A1 1/2011 Wallaert
2011/0010660 A1 1/2011 Thorson et al.
2011/0032932 A2 2/2011 Pyeon et al.
2011/0040785 A1 2/2011 Steenberg et al.
2011/0061014 A1 3/2011 Frader-Thompson et al.
2011/0063126 A1 3/2011 Kennedy et al.
2012/0012662 A1 1/2012 Leen et al.
2012/0046792 A1 2/2012 Secor
2012/0065805 A1 3/2012 Montalvo
2012/0116593 A1 5/2012 Amundson et al.
2012/0181010 A1 7/2012 Schultz et al.

FOREIGN PATENT DOCUMENTS

EP 2241836 A1 10/2010
EP 2241837 A1 10/2010
GB 2117573 A 10/1983
WO 02056540 A2 7/2002
WO 2008100641 A1 8/2008

OTHER PUBLICATIONS

Related case U.S. Appl. No. 12/603,450, filed Oct. 21, 2009 to Wojciech Grohman, entitled "Alarm and Diagnostics System and Method for a Distributed-Architecture Heating, Ventilation and Air Conditioning Network".
Related case U.S. Appl. No. 12/603,382, filed Oct. 21, 2009 to Wojciech Grohman, entitled "Device Abstraction System and Method for a Distributed-Architecture Heating, Ventilation and Air Conditioning System".
Related case U.S. Appl. No. 12/603,504, filed Oct. 21, 2009 to Amanda Filbeck et al., entitled "System and Method of Use for a User Interface Dashboard of a Heating, Ventilation and Air Conditioning Network".
Related case U.S. Appl. No. 12/603,449, filed Oct. 21, 2009 to Wojciech Grohman et al., entitled "System and Method of Use for a User Interface Dashboard of a Heating, Ventilation and Air Conditioning Network".
Related case U.S. Appl. No. 12/603,460, filed Oct. 21, 2009 to Wojciech Grohman et al., entitled "System and Method of Use for a User Interface Dashboard of a Heating, Ventilation and Air Conditioning Network".
Related case U.S. Appl. No. 12/603,526, filed Oct. 21, 2009 to Wojciech Grohman et al., entitled "Communication Protocol System and Methof for a Distributed-Architecture Heating, Ventilation and Air Conditioning Network K".
Related case U.S. Appl. No. 12/603,532, filed Oct. 21, 2009 to Wojciech Grohman, entitled "Communication Protocol System and Method for a Distributed-Architecture Heating, Ventilation and Air Conditioning Network".
Related case U.S. Appl. No. 12/603,475, filed Oct. 21, 2009 to Suresh Kumar Devineni et al., entitled "System and Method of Use for a User Interface Dashboard of a Heating, Ventilation and Air Conditioning Network".
Related case U.S. Appl. No. 12/603,362, filed Oct. 21, 2009 to Wojciech Grohman et al., entitled "Architecture Heating, Ventilation and Air Conditioning System".
Related case U.S. Appl. No. 12/603,473, filed Oct. 21, 2009 to Wojciech Grohman et al., entitled "System and Method for Zoning a Distributed-Architecture Heating, Ventilation and Air Conditioning Network".
Related case U.S. Appl. No. 12/603,407, filed Oct. 21, 2009 to Amanda Filbeck et al., entitled "System and Method for Zoning a Distributed-Architecture Heating, Ventilation and Air Conditioning Network".
Related case U.S. Appl. No. 12/603,496, filed Oct. 21, 2009 to Wojciech Grohman et al., entitled "Device Abstraction System and Method for a Distributed-Architecture Heating, Ventilation and Air Conditioning System".
Related case U.S. Appl. No. 12/603,482, filed Oct. 21, 2009 to Muhammad Mirza et al., entitled "System and Method of Use for a User Interface Dashboard of a Heating, Ventilation and Air Conditioning Network".
Related case U.S. Appl. No. 12/603,488, filed Oct. 21, 2009 to Muhammad Mirza et al., entitled "System and Method of Use for a User Interface Dashboard of a Heating, Ventilation and Air Conditioning Network".
Related case U.S. Appl. No. 12/603,495, filed Oct. 21, 2009 to Thomas Pavlak et al., entitled "System and Method of Use for a User Interface Dashboard of a Heating, Ventilation and Air Conditioning Network".
Related case U.S. Appl. No. 12/603,497, filed Oct. 21, 2009 to Muhammad Mirza et al., entitled "System and Method of Use for a User Interface Dashboard of a Heating, Ventilation and Air Conditioning Network".
Related case U.S. Appl. No. 12/603,431, filed Oct. 21, 2009 to Wojciech Grohman et al., entitled "General Control Technique in a Heating, Ventilation and Air Conditioning Network".
Related case U.S. Appl. No. 12/603,502, filed Oct. 21, 2009 to Wojciech Grohman et al., entitled "System and Method of Use for a User Interface Dashboard of a Heating, Ventilation and Air Conditioning Network".
Related case U.S. Appl. No. 12/603,489, filed Oct. 21, 2009 to Wojciech Grohman, entitled "System and Method for Zoning a Distributed-Architecture Heating, Ventilation and Air Conditioning Network".
Related case U.S. Appl. No. 12/603,527, filed Oct. 21, 2009 to Darko Hadzidedic et al., entitled "Memory Recovery Scheme and Data Structure in a Heating, Ventilation and Air Conditioning Network".
Related case U.S. Appl. No. 12/603,479, filed Oct. 21, 2009 to Wojciech Grohman et al., entitled "Device Abstraction System and Method for a Distributed-Architecture Heating, Ventilation and Air Conditioning System".
Related case U.S. Appl. No. 12/603,536, filed Oct. 21, 2009 to Timothy Wallaert et al., entitled "Communication Protocol System and Method for a Distributed-Architecture Heating, Ventilation and Air Conditioning Network".
Related case U.S. Appl. No. 12/603,509, filed Oct. 21, 2009 to Timothy Wallaert et al., entitled "System and Method of Use for a User Interface Dashboard of a Heating, Ventilation and Air Conditioning Network".
Related case U.S. Appl. No. 12/603,512, filed Oct. 21, 2009 to Wojciech Grohman et al., entitled "Programming and Configuration in a Heating, Ventilation and Air Conditioning Network".
Related case U.S. Appl. No. 12/603,464, filed Oct. 21, 2009 to Wojciech Grohman et al., entitled "Alarm and Diagnostics System and Method for a Distributed-Architecture Heating, Ventilation and Air Conditioning Network".
Related case U.S. Appl. No. 12/603,525, filed Oct. 21, 2009 to Wojciech Grohman et al., entitled "Method of Controlling Equipment in a Heating, Ventilation and Air Conditioning Network".
Related case U.S. Appl. No. 12/603,520, filed Oct. 21, 2009 to Darko Hadzidedic et al., entitled "Alarm and Diagnostics System and Method for a Distributed-Architecture Heating, Ventilation and Air Conditioning Network".
Related case U.S. Appl. No. 12/603,539, filed Oct. 21, 2009 to Wojciech Grohman et al., entitled "Communication Protocol System and Method for a Distributed-Architecture Heating, Ventilation and Air Conditioning Network".
Related case U.S. Appl. No. 12/603,420, filed Oct. 21, 2009 to Darko Hadzidedic et al., entitled "Alarm and Diagnostics System and Method for a Distributed-Architecture Heating, Ventilation and Air Conditioning Network".
Related case U.S. Appl. No. 12/603,483, filed Oct. 21, 2009 to Wojciech Grohman et al., entitled "Device Abstraction System and Method for a Distributed-Architecture Heating, Ventilation and Air Conditioning System".
Related case U.S. Appl. No. 12/603,514, filed Oct. 21, 2009 to Thomas Pavlak et al., entitled "System and Method of Use for a User Interface Dashboard of a Heating, Ventilation and Air Conditioning Network".
Related case U.S. Appl. No. 12/603,515, filed Oct. 21, 2009 to Wojciech Grohman et al., entitled "Alarm and Diagnostics System and Method for a Distributed-Architecture Heating, Ventilation and Air Conditioning Network".
Related case U.S. Appl. No. 12/603,490, filed Oct. 21, 2009 to Wojciech Grohman, entitled "System Recovery in a Heating, Ventilation and Air Conditioning Network".
Related case U.S. Appl. No. 12/603,523, filed Oct. 21, 2009 to Wojciech Grohman et al., entitled "Alarm and Diagnostics System and Method for a Distributed-Architecture Heating, Ventilation and Air Conditioning".
Related case U.S. Appl. No. 12/603,493, filed Oct. 21, 2009 to Wojciech Grohman et al., entitled "System Recovery in a Heating, Ventilation and Air Conditioning Network".
Related case U.S. Appl. No. 12/603,547, filed Oct. 21, 2009 to Wojciech Grohman, entitled "Communication Protocol System and Method for a Distributed-Architecture Heating, Ventilation and Air Conditioning Network".
Related case U.S. Appl. No. 12/603,531, filed Oct. 21, 2009 to Wojciech Grohman, entitled "Memory Recovery Scheme and Data Structure in a Heating, Ventilation and Air Conditioning Network".
Related case U.S. Appl. No. 12/603,555, filed Oct. 21, 2009 to Wojciech Grohman, entitled "Communication Protocol System and Method for a Distributed-Architecture Heating, Ventilation and Air Conditioning Network".

Related case U.S. Appl. No. 12/603,562, filed Oct. 21, 2009 to Wojciech Grohman et al., entitled "Communication Protocol System and Method for a Distributed-Architecture Heating, Ventilation and Air Conditioning Network".
Related case U.S. Appl. No. 12/603,566, filed Oct. 21, 2009 to Wojciech Grohman, entitled "Communication Protocol System and Method for a Distributed-Architecture Heating, Ventilation and Air Conditioning Network".
Related case U.S. Appl. No. 12/603,451, filed Oct. 21, 2009 to Timothy Wallaert, entitled "Alarm and Diagnostics System and Method for a Distributed-Architecture Heating, Ventilation and Air Conditioning Network".
Related case U.S. Appl. No. 12/603,553, filed Oct. 21, 2009 to Wojciech Grohman et al., entitled "Communication Protocol System and Method for a Distributed-Architecture Heating, Ventilation and Air Conditioning Network".
Related case U.S. Appl. No. 12/603,487, filed Oct. 21, 2009 to Wojciech Grohman, entitled "System Recovery in a Heating, Ventilation and Air Conditioning Network".
Related case U.S. Appl. No. 12/603,558, filed Oct. 21, 2009 to Wojciech Grohman, entitled "Communication Protocol System and Method for a Distributed-Architecture Heating, Ventilation and Air Conditioning Network".
Related case U.S. Appl. No. 12/603,468, filed Oct. 21, 2009 to Wojciech Grohman et al., entitled "Programming and Configuration in a Heating, Ventilation and Air Conditioning Network".
Related case U.S. Appl. No. 12/603,560, filed Oct. 21, 2009 to Wojciech Grohman, entitled "Communication Protocol System and Method for a Distributed-Architecture Heating, Ventilation and Air Conditioning Network".
Related case U.S. Appl. No. 12/603,519, filed Oct. 21, 2009 to Thomas Pavlak, entitled "System and Method of Use for a User Interface Dashboard of a Heating, Ventilation and Air Conditioning Network".
Related case U.S. Appl. No. 12/603,499, filed Oct. 21, 2009 to Jimmy Curry et al., entitled "Alarm and Diagnostics System and Method for a Distributed-Architechture Heating, Ventilation and Air Conditioning Network".
Related case U.S. Appl. No. 12/603,534, filed Oct. 21, 2009 to Timothy Wallaert et al., entitled "Flush Wall Mount Thermostat and In-Set Mounting Plate for a Heating, Ventilation and Air Conditioning System".
Related case U.S. Appl. No. 29/345,748, filed Oct. 21, 2009 to Timothy Wallaert et al., entitled "Thin Cover Plate for an Electronic System Controller".
Related case U.S. Appl. No. 29/345,747, filed Oct. 21, 2009 to Timothy Wallaert et al., entitled "Thin Cover Plate for an Electronic System Controller".
Gallas, B., et al., "Embedded Pentium® Processor System Design for Windows CE," WESCON 1998, pp. 114-123.
"iView-100 Series (iView/iView-100-40) Handheld Controller User's Manual," ICP DAS, Mar. 2006, Version 2.0.
"Spectra™ Commercial Zoning System, Engineering Data," Lennox, Bulletin No. 210366E, Oct. 2002, 33 pages.
Sharma, A., "Design of Wireless Sensors Network for Building Management Systems," University of California-Berkley, 57 pages.
"Linux Programmer's Manual," UNIX Man Pages: Login (1), http://unixhelp.ed.ac.uk/CGI/man-cgi?login, Util-linux 1.6, Nov. 4, 1996, 4 pages.
Checket-Hanks, B., "Zoning Controls for Convenience's Sakes, High-End Residential Controls Move Into New Areas," Air Conditioning, Heating & Refrigeration News, ABI/INFORM Global, Jun. 28, 2004, 3 pages.
Leeb, G., "A User Interface for Home-Net," IEEE Transactions on Consumer Electronics, vol. 40, Issue 4, Nov. 1994, pp. 897-902.
"IPMI—Intelligent Platform Management Interface Specification v1.5," Document Revision 1.1, Intel Hewlett-Packard NEC Dell, Feb. 20, 2002, 460 pages.
Nash, H., "Fire Alarm Systems for Health Care Facilities," IEEE Transactions on Industry Applications, vol. 1A-19, No. 5, Sep./Oct. 1983, pp. 848-852.
Bruggeman, E., et al., "A Multifunction Home Control System," IEEE Transactions on Consumer Electronics, CE-29, Issue 1, 10 pages.
Fischer, H., et al., "Remote Building Management and DDc-Technology to Operate Distributed HVAC-Installations," The first International Telecommunications Energy Special Conference, TELESCON '94, Apr. 11-15, 1994, pp. 127-132.
"Define Track at Dictionary.com ," http://dictionary.reference.com/browse/track, Mar. 12, 2013, 3 pages.
"Definition of Track by Macmillan Dictionary," http://www.macmillandictionary.com/dictionary/british/track, Mar. 12, 2013, 4 pages.
"Definition of track by the Free Online Dictionary, Thesaurus, and Encyclopedia," http://www.thefreedictionary.com/track, Mar. 12, 2013, 6 pages.

* cited by examiner

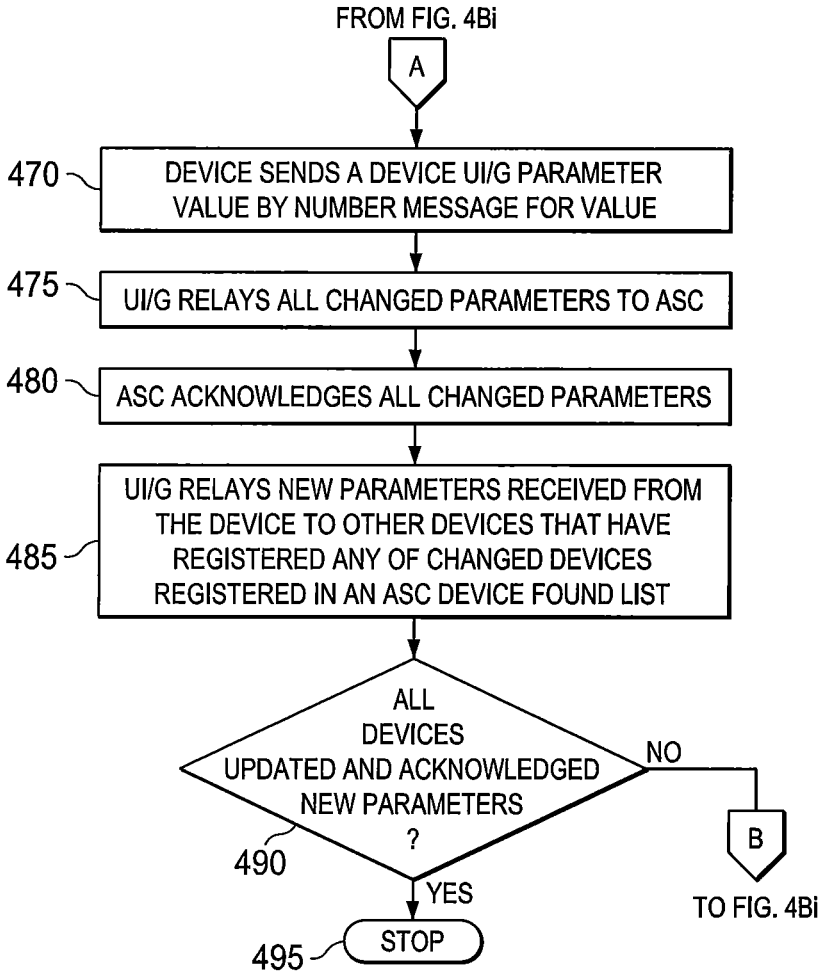
FIG. 4Bii

FIG. 6C1-1
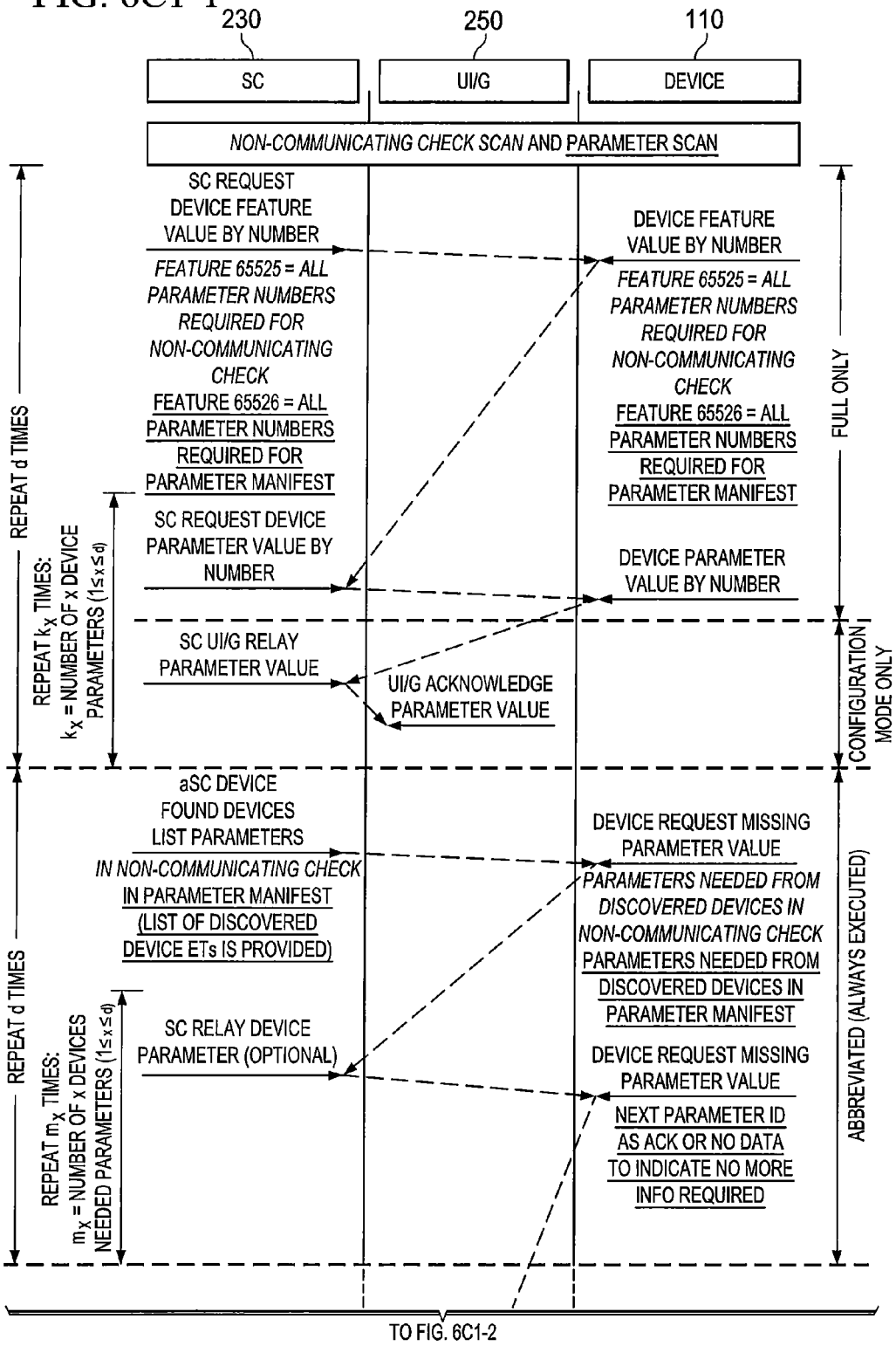

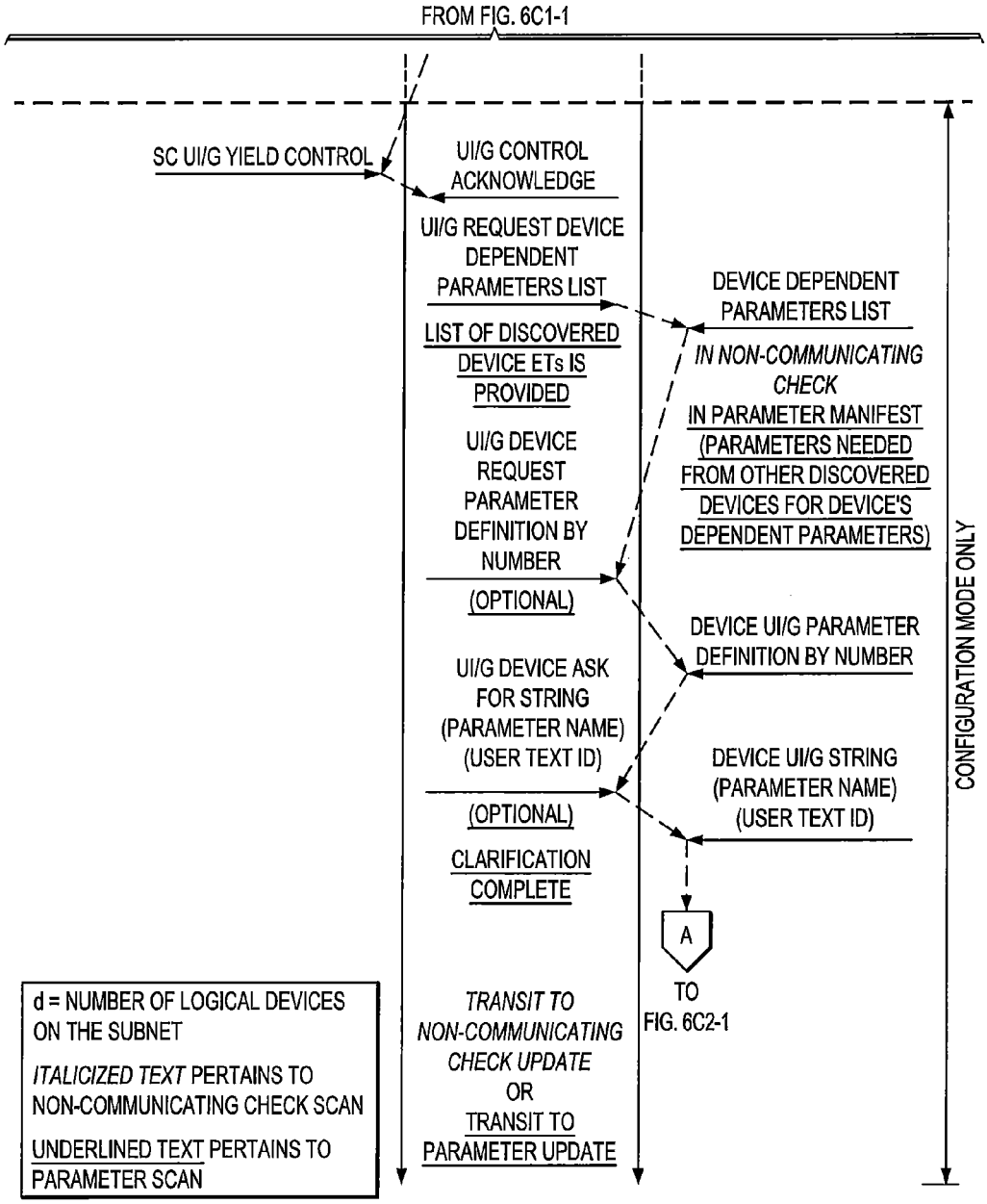
FIG. 6C1-2

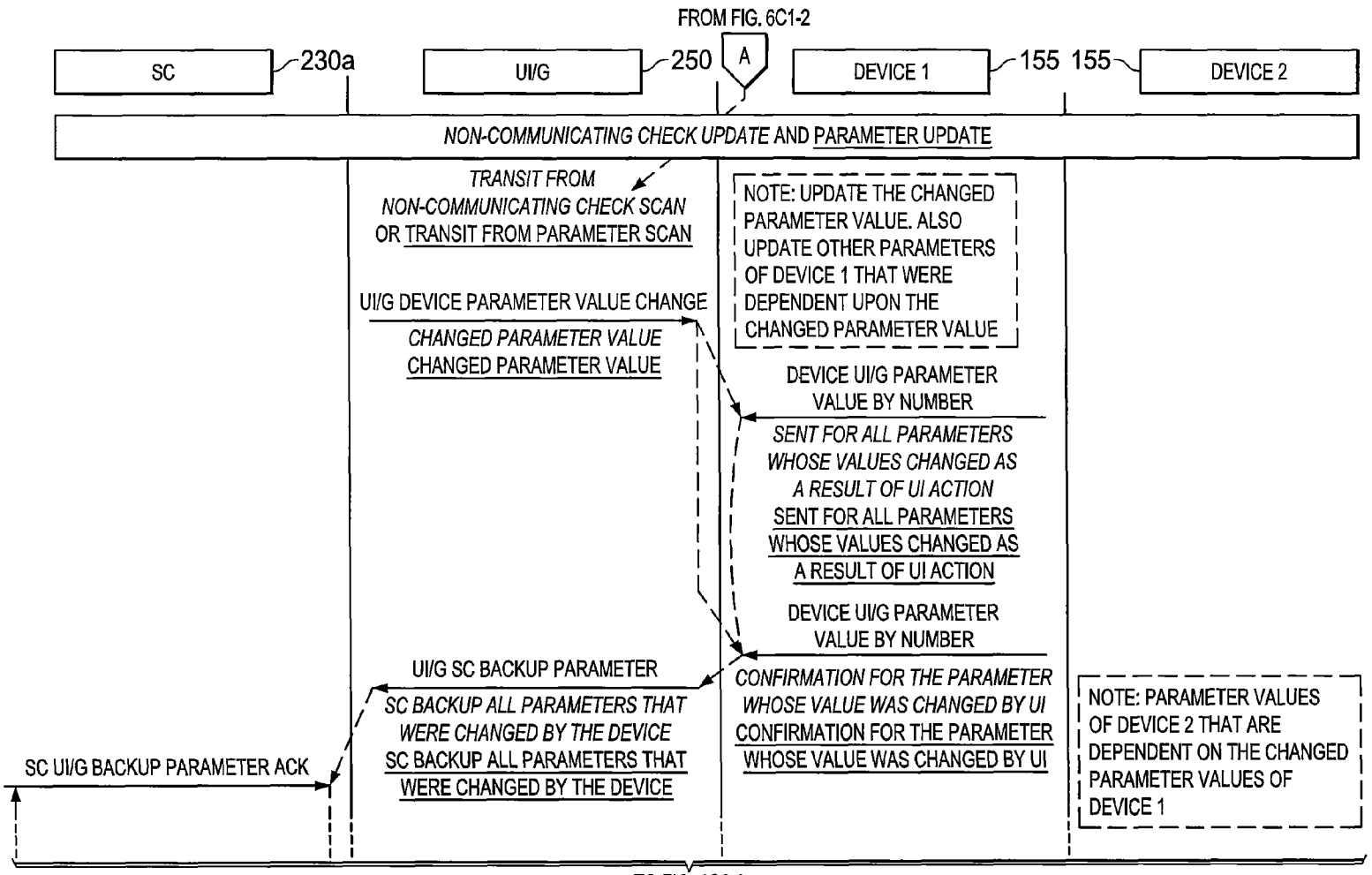
FIG. 6C2-1

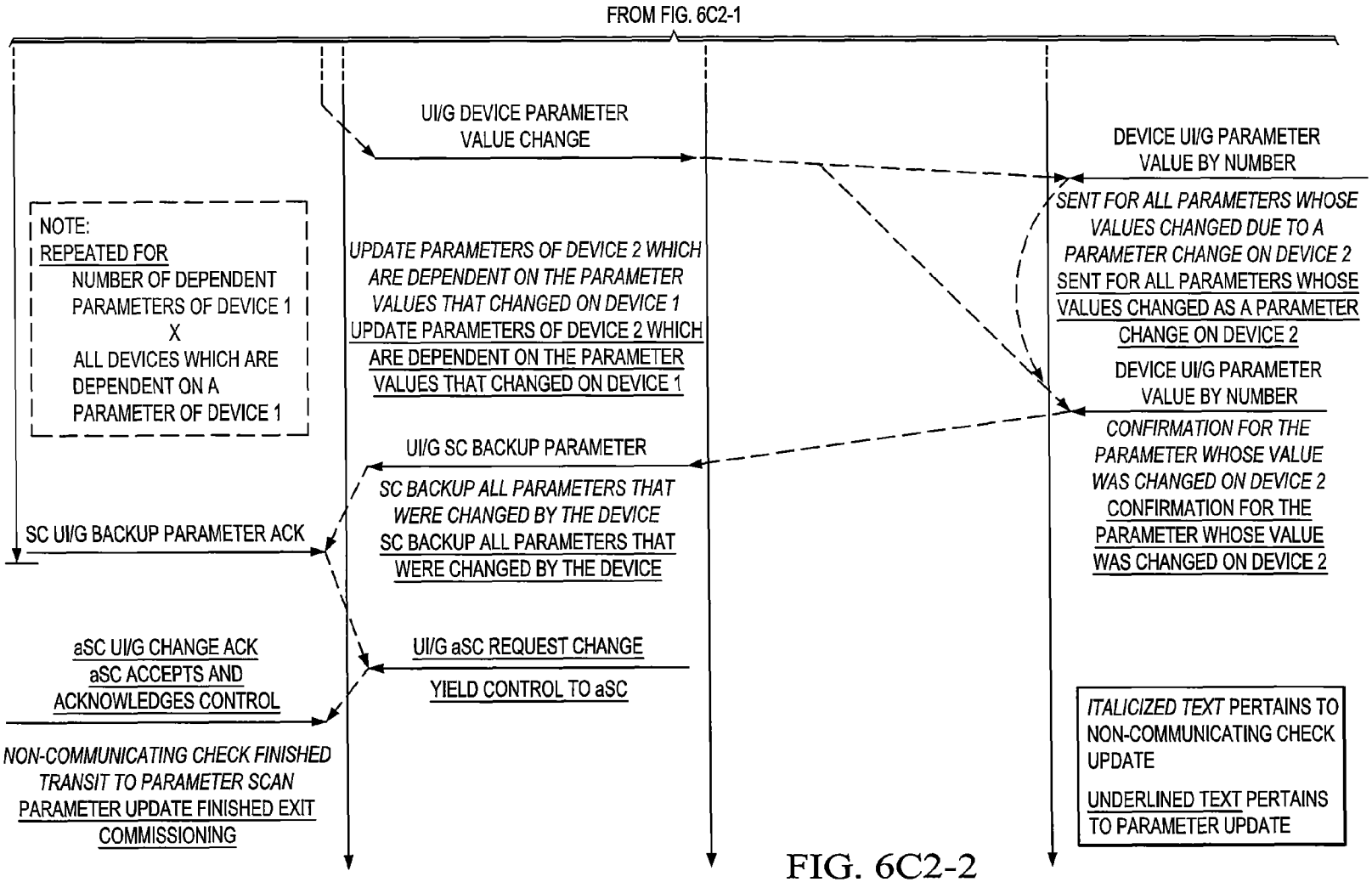
FIG. 6C2-2

FIG. 7A1

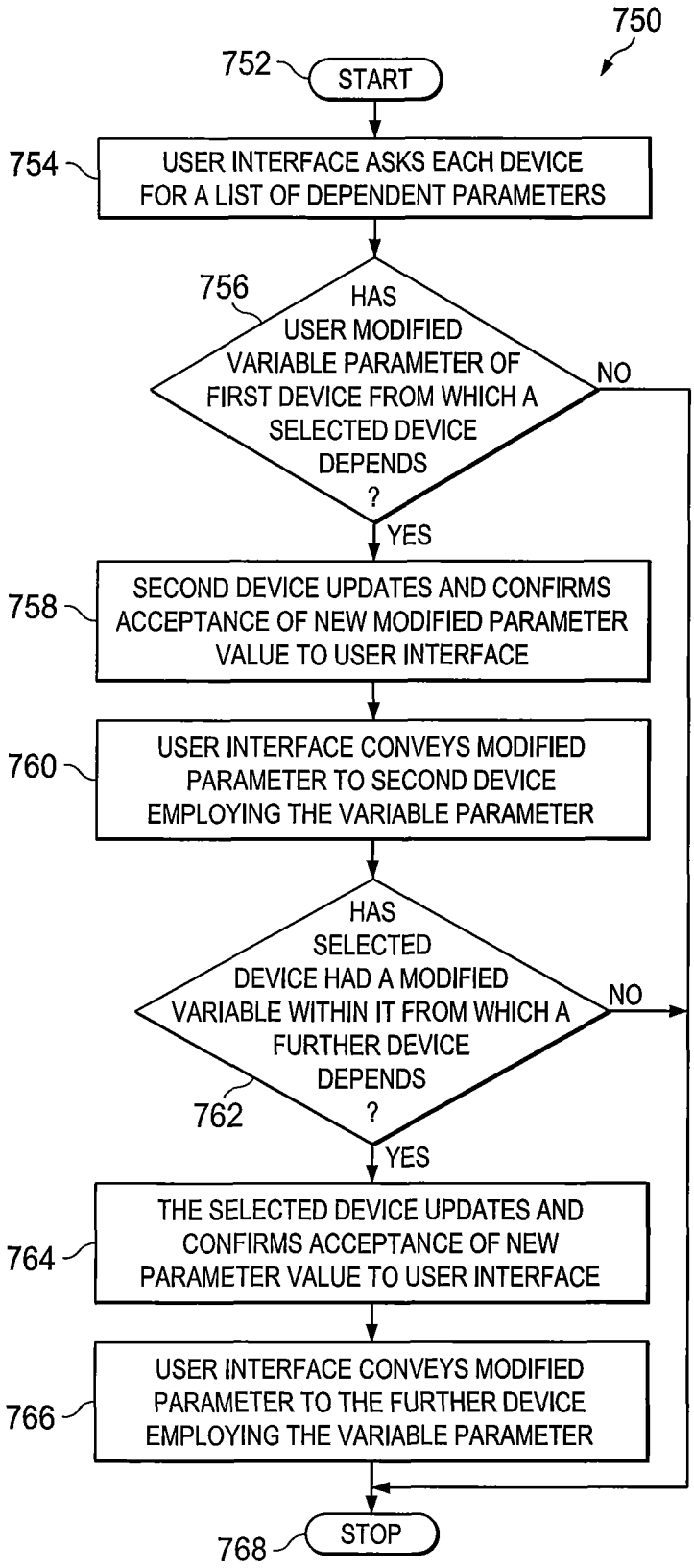
FIG. 7A2

MEMORY RECOVERY SCHEME AND DATA STRUCTURE IN A HEATING, VENTILATION AND AIR CONDITIONING NETWORK

CROSS-REFERENCE TO RELATED APPLICATIONS

This application claims the benefit of U.S. Provisional Application Ser. No. 61/167,135, filed by Grohman, et al., on Apr. 6, 2009, entitled "Comprehensive HVAC Control System", and is a continuation-in-part application of application Ser. No. 12/258,659, filed by Grohman on Oct. 27, 2008, entitled "Apparatus and Method for Controlling an Environmental Conditioning Unit," both of which are commonly assigned with this application and incorporated herein by reference. This application is also related to the following U.S. patent applications, which are filed on even date herewith, commonly assigned with this application and incorporated herein by reference:

| Ser. No. | Inventors | Title |
|---|---|---|
| 12/603,464 | Grohman, et al. | "Alarm and Diagnostics System and Method for a Distributed-Architecture Heating, Ventilation and Air Conditioning Network" |
| 12/603,534 | Wallaert, et al. | "Flush Wall Mount Controller and In-Set Mounting Plate for a Heating, Ventilation and Air Conditioning System" |
| 12/603,449 | Thorson, et al. | "System and Method of Use for a User Interface Dashboard of a Heating, Ventilation and Air Conditioning Network" |
| 12/603,382 | Grohman | "Device Abstraction System and Method for a Distributed-Architecture Heating, Ventilation and Air Conditioning Network" |
| 12/603,526 | Grohman, et al. | "Communication Protocol System and Method for a Distributed-Architecture Heating, Ventilation and Air Conditioning Network" |
| 12/603,527 | Hadzidedic | "Memory Recovery Scheme and Data Structure in a Heating, Ventilation and Air Conditioning Network" |
| 12/603,490 | Grohman | "System Recovery in a Heating, Ventilation and Air Conditioning Network" |
| 12/603,473 | Grohman, et al. | "System and Method for Zoning a Distributed-Architecture Heating, Ventilation and Air Conditioning Network" |
| 12/603,525 | Grohman, et al. | "Method of Controlling Equipment in a Heating, Ventilation and Air Conditioning Network" |
| 12/603,512 | Grohman, et al. | "Programming and Configuration in a Heating, Ventilation and Air Conditioning Network" |
| 12/603,431 | Mirza, et al. | "General Control Techniques in a Heating, Ventilation and Air Conditioning Network" |

TECHNICAL FIELD

This application is directed, in general, to distributed-architecture heating, ventilation and air conditioning (HVAC) system, more specifically, to a memory scheme and data recovery in an HVAC network.

BACKGROUND

Climate control systems, also referred to as HVAC systems (the two terms will be used herein interchangeably), are employed to regulate the temperature, humidity and air quality of premises, such as a residence, office, store, warehouse, vehicle, trailer, or commercial or entertainment venue. The most basic climate control systems either move air (typically by means of an air handler or, or more colloquially, a fan or blower), heat air (typically by means of a furnace) or cool air (typically by means of a compressor-driven refrigerant loop). A thermostat is typically included in the climate control systems to provide some level of automatic temperature control. In its simplest form, a thermostat turns the climate control system on or off as a function of a detected temperature. In a more complex form, a thermostat may take other factors, such as humidity or time, into consideration. Still, however, the operation of a thermostat remains turning the climate control system on or off in an attempt to maintain the temperature of the premises as close as possible to a desired setpoint temperature. Climate control systems as described above have been in wide use since the middle of the twentieth century.

SUMMARY

One aspect provides a method for conveying information between a communicating first device and a second device coupled to the first device of a HVAC network. In an embodiment, the method comprises checking a subnet of the HVAC network for a second device by the communicating first device. The method also comprises determining whether the second coupled device is a non-communicating device. The method still further comprises allowing an installer to set parameters of the second device through employment of the first communicating device if the second device is a non-communicating device.

Another aspect provides an HVAC system. In an embodiment, the system comprises: a first communicating device and a second device coupled to the first device. The first device can determine if the second device is a communicating device. The first communicating device can allow an installer to set parameters for the non-communicating device.

Yet another aspect provides an HVAC system. In an embodiment, a first communicating device and a second device coupled to the first device. The first device can determine if the second device is a communicating device. The first communicating device can allow an installer to set parameters for the non-communicating device, wherein the Installer sets the internal parameters through employment of an Internet.

BRIEF DESCRIPTION

Reference is now made to the following descriptions taken in conjunction with the accompanying drawings, in which.

Figure 1:
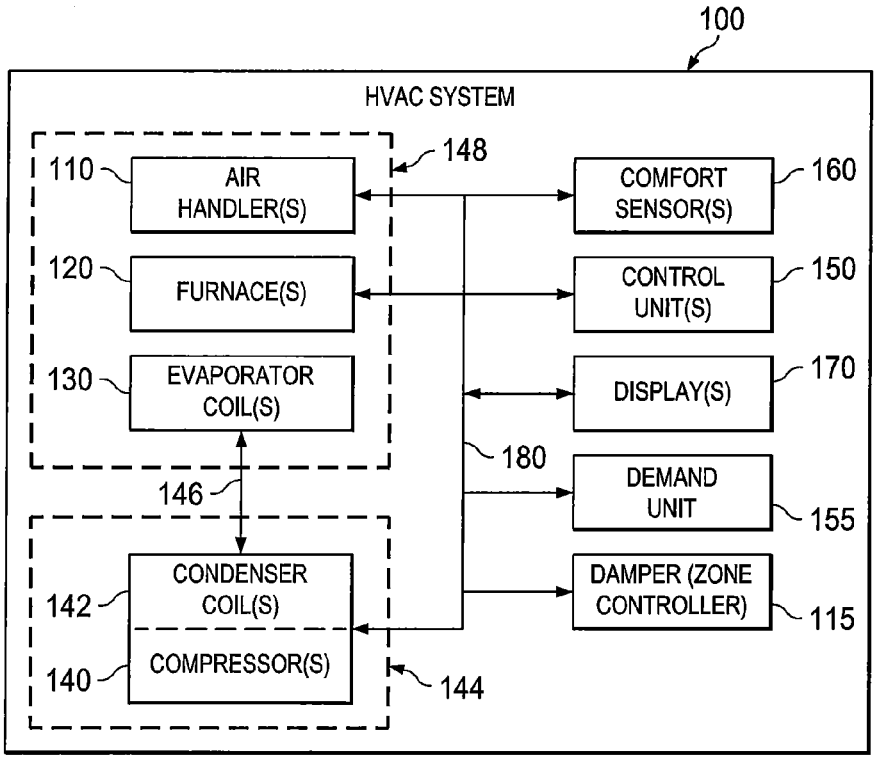
FIG. 1 is a high-level block diagram of an HVAC system within which a device abstraction system and method may be contained or carried out.
Figure 2:
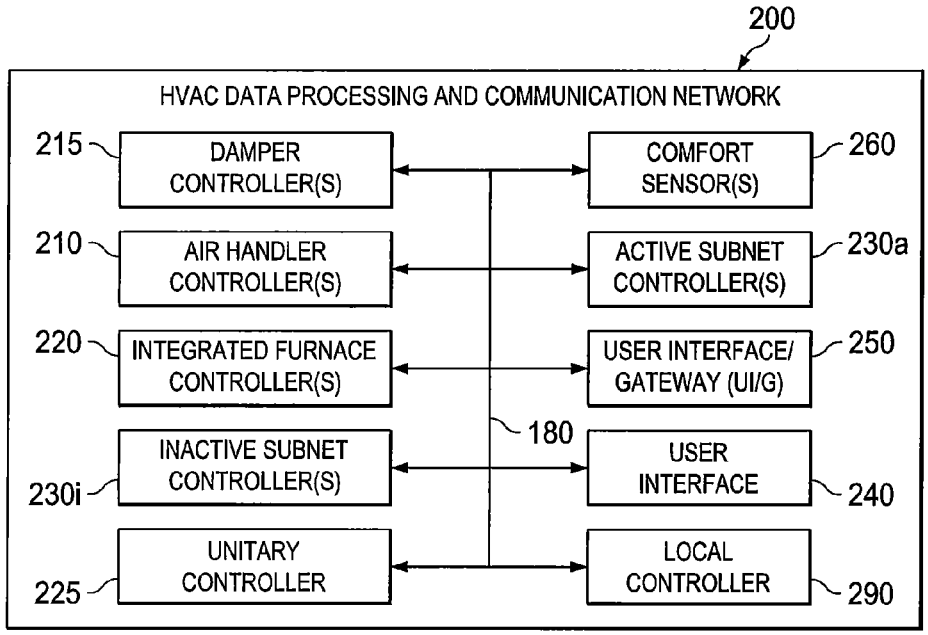
FIG. 2 is a high-level block diagram of one embodiment of an HVAC data processing and communication network 200.
Figure 4A:
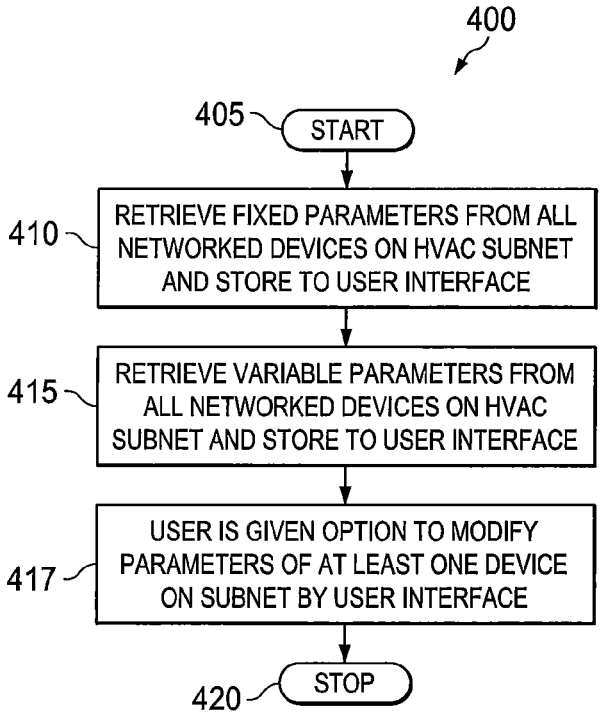
FIG. 4A is an illustration of method flow of a first approach directed towards a parameter configuration in a communicating HVAC network.
Figure 5:
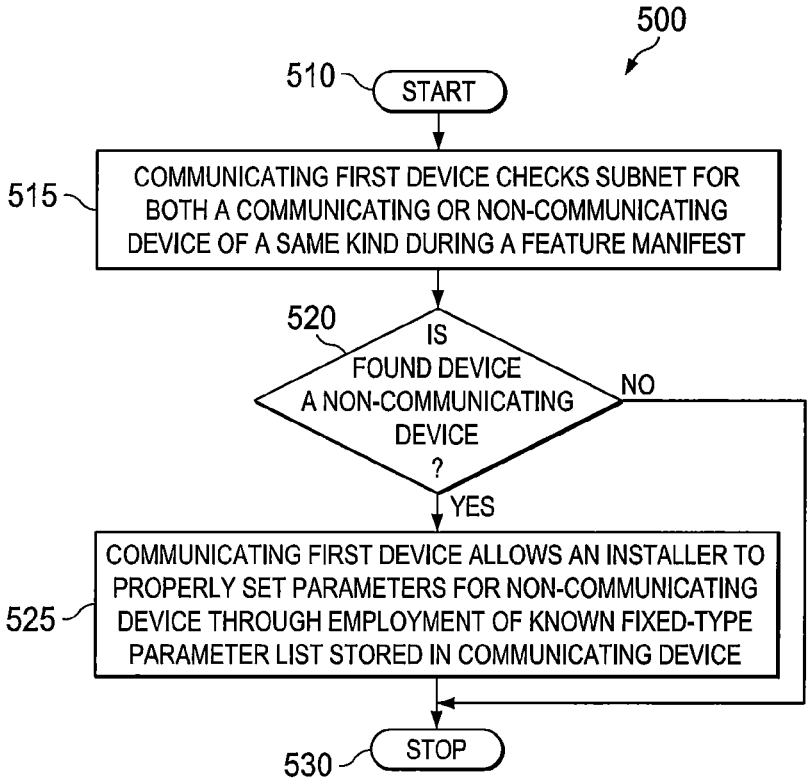
Figure 4B:
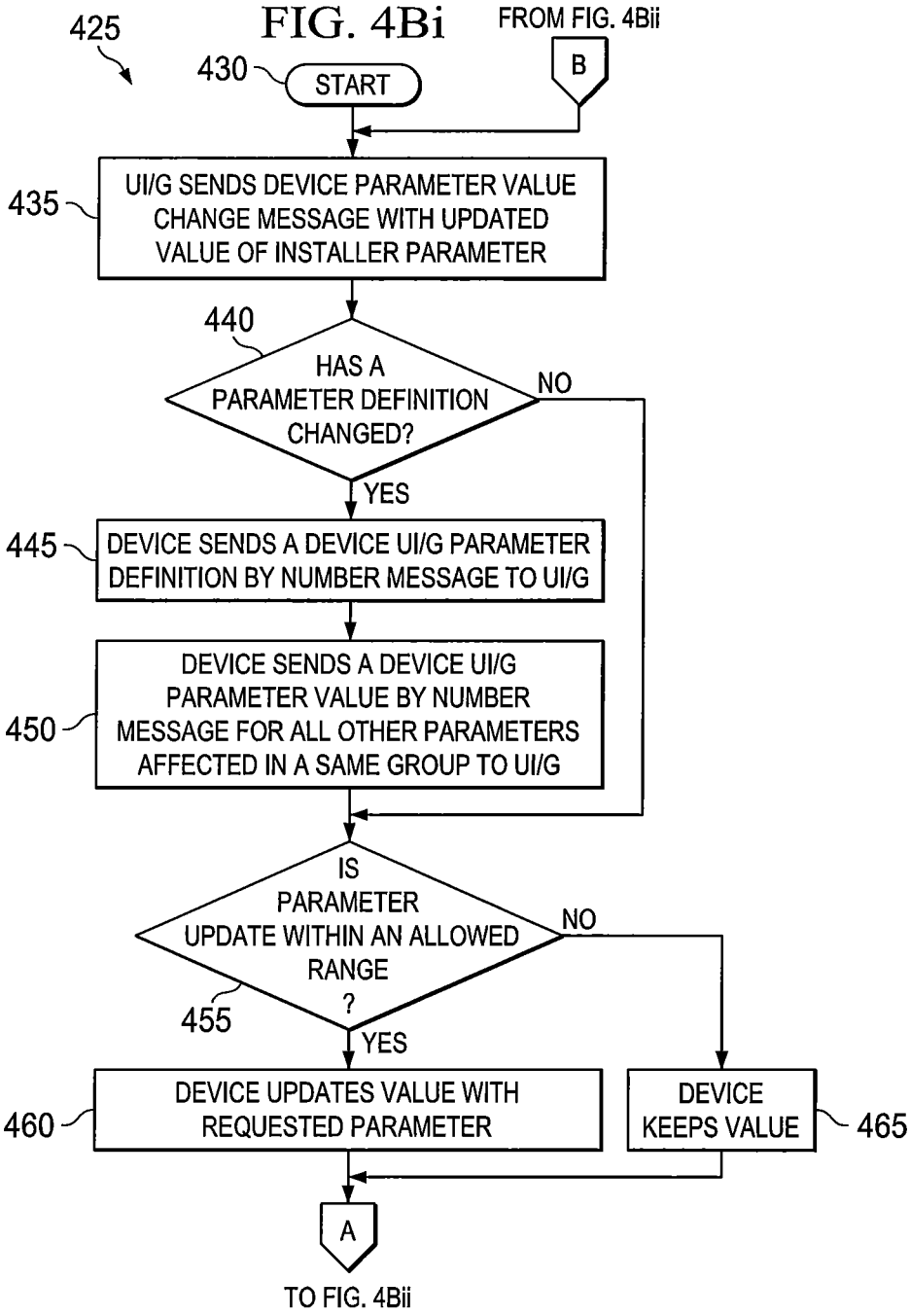
Figure 6A:
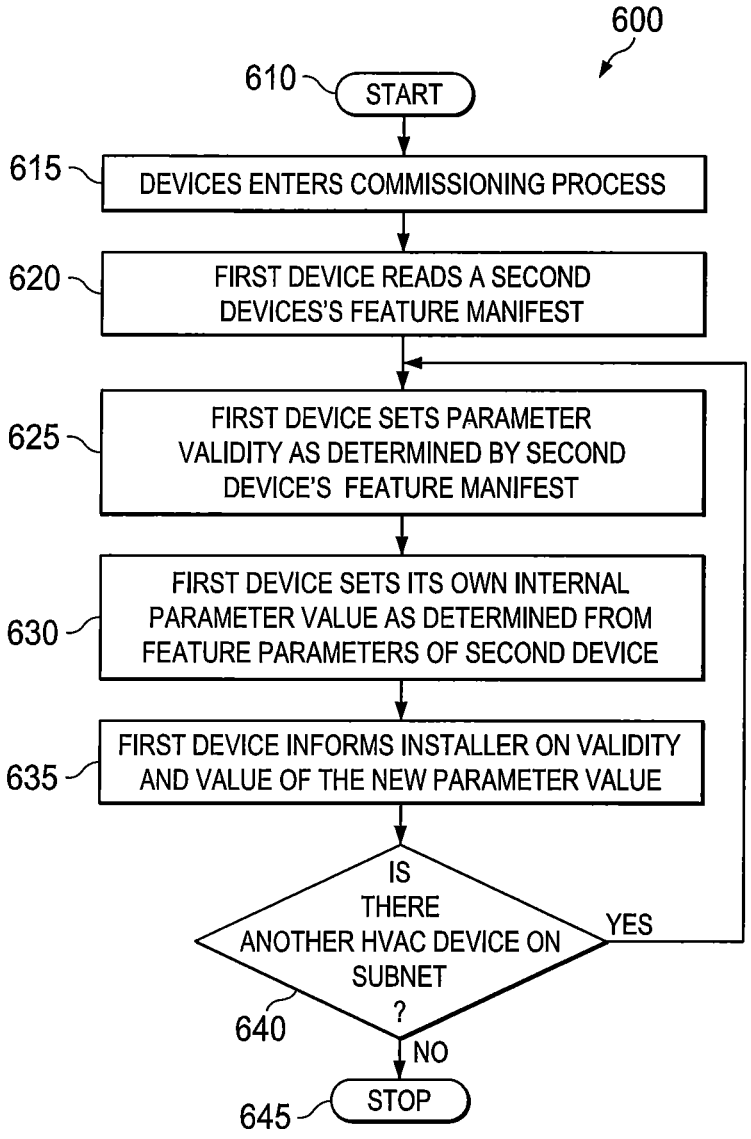
Figure 6B:
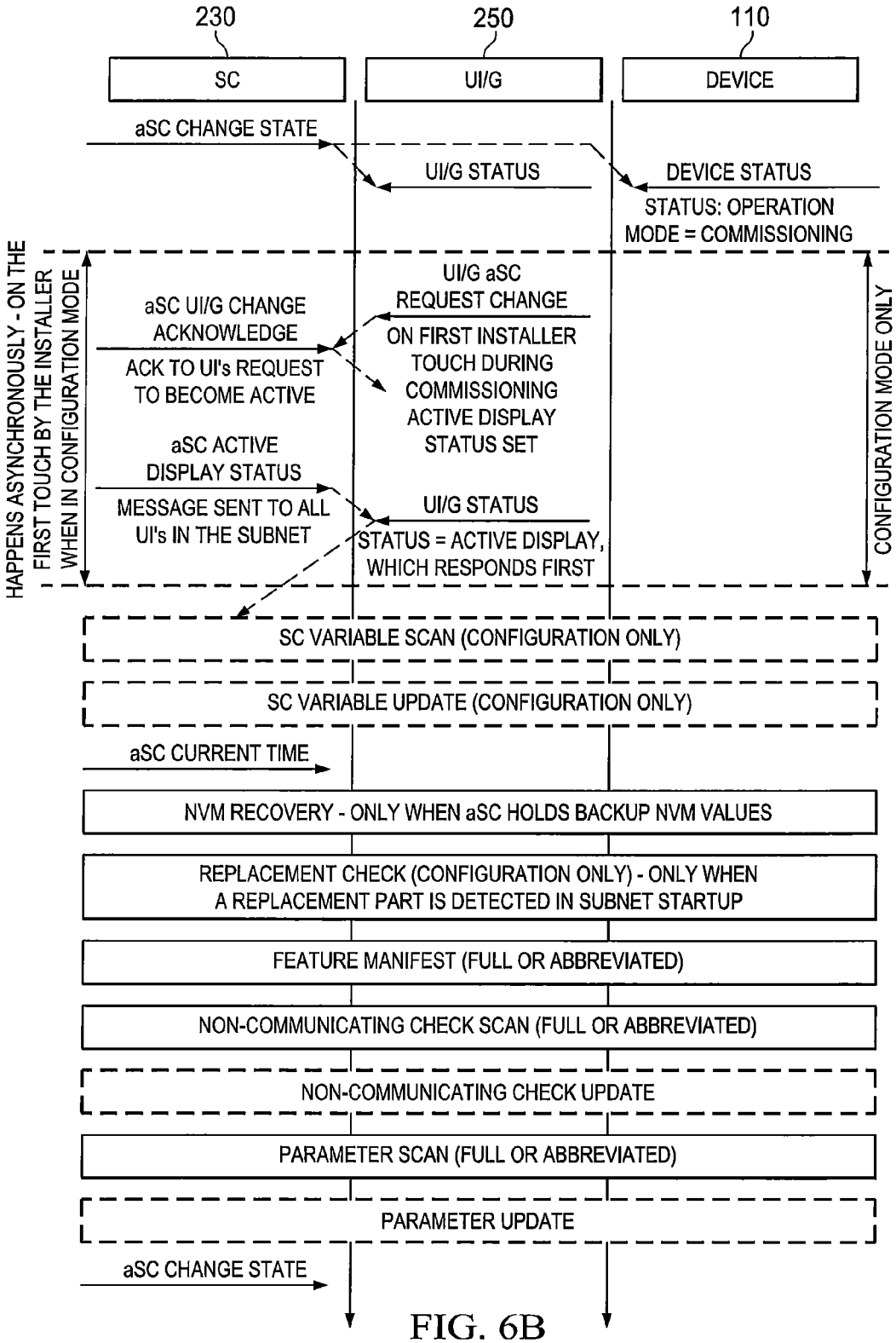
Figure 7B:
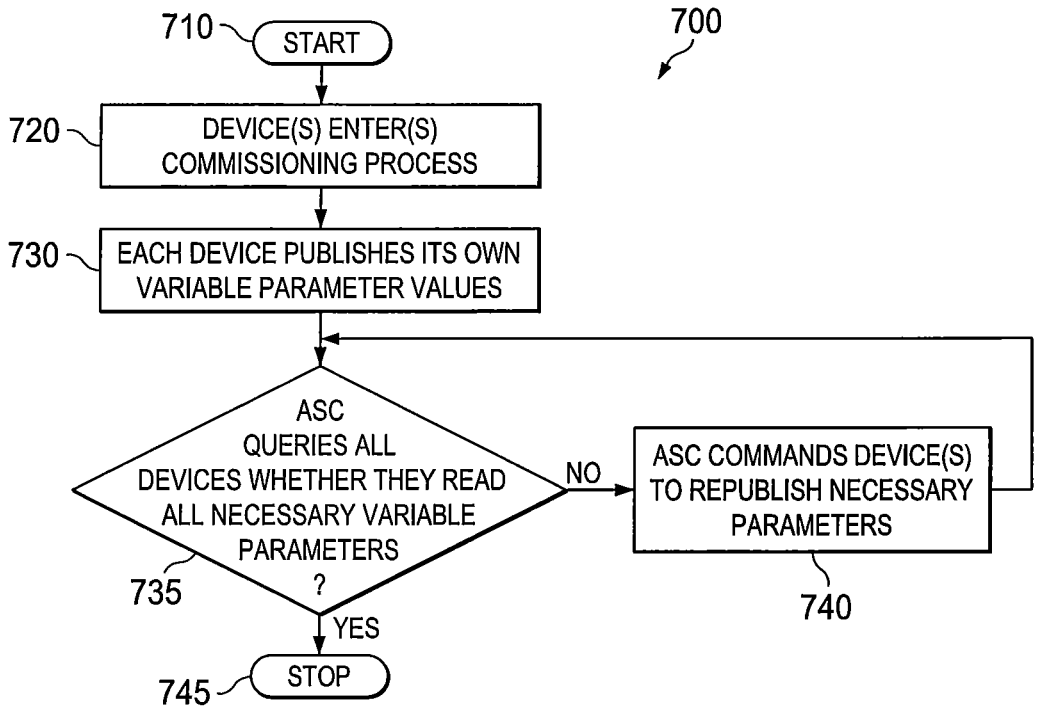
Figure 7B:
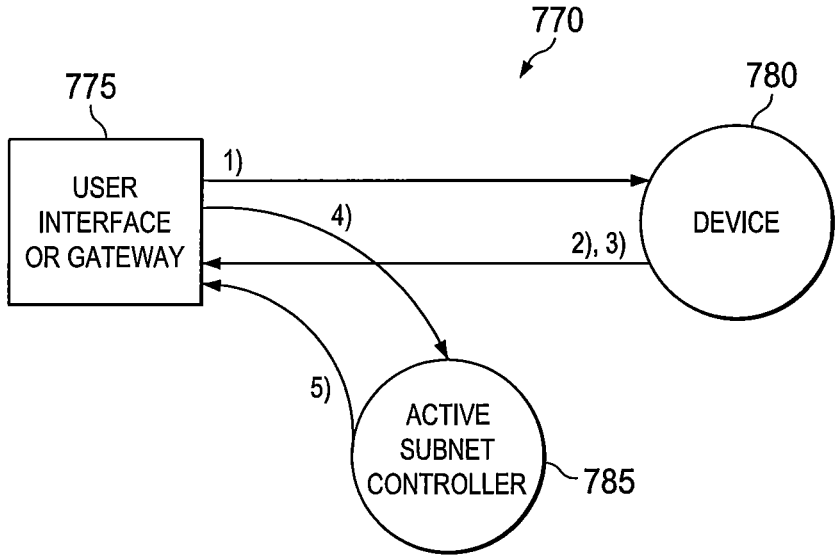

FIG. 4Bi and 4Bii illustrate an exemplary flow diagram of a second approach of a method directed towards configuration of variable parameters of an HVAC device that are dependent upon other parameters, having a value and a range, within that same HVAC device;

FIG. 5 illustrates an exemplary flow for a method for a third approach commissioning an HVAC device attached to a non-communicating device that enables the use of a manifest of parameter types to configure a non-communicating HVAC device;

FIG. 6A illustrates an exemplary signaling flow for a method for commissioning parameters when validity and value of internal parameters of a device depend on network configuration and/or other device features of the device or devices;

FIG. 6B illustrates an exemplary overview of signaling flows implemented in a commissioning between a subnet controller, a user interface/gateway and another device;

FIG. 6C1 illustrates an exemplary signal flow associated with a "Non-Communicating Check Scan" and "Parameter Scan" sub-states of commissioning state in an HVAC network;

FIG. 6C2 illustrates an exemplary signal flow associated with a "Non-Communicating Check Update" and "Parameter Update" sub-states of commissioning state in an HVAC network;

FIG. 7A1 illustrates an exemplary embodiment of a method flow of propagating variable parameters in an HVAC system as initiated by a subnet controller;

FIG. 7A2 illustrates an exemplary embodiment of illustrates an exemplary embodiment of a method flow of propagating variable parameters in an HVAC system as initiated by a user interface;

FIG. 7B is an illustration of a high-level block diagram of commissioning steps that includes an active subnet controller that can be practices with the method of FIG. 7A2.

Figure 8A:
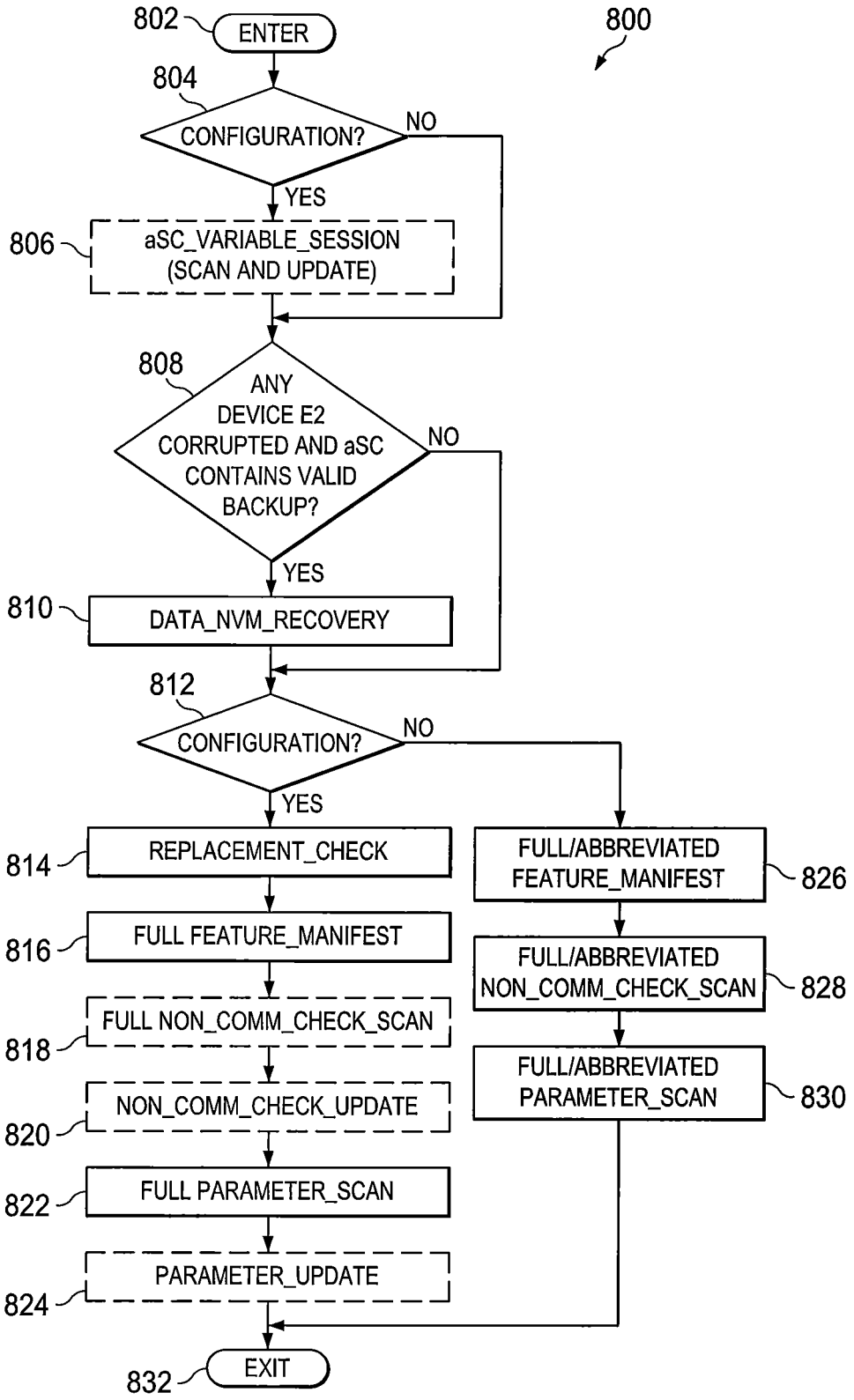
Figures 1, 8B:
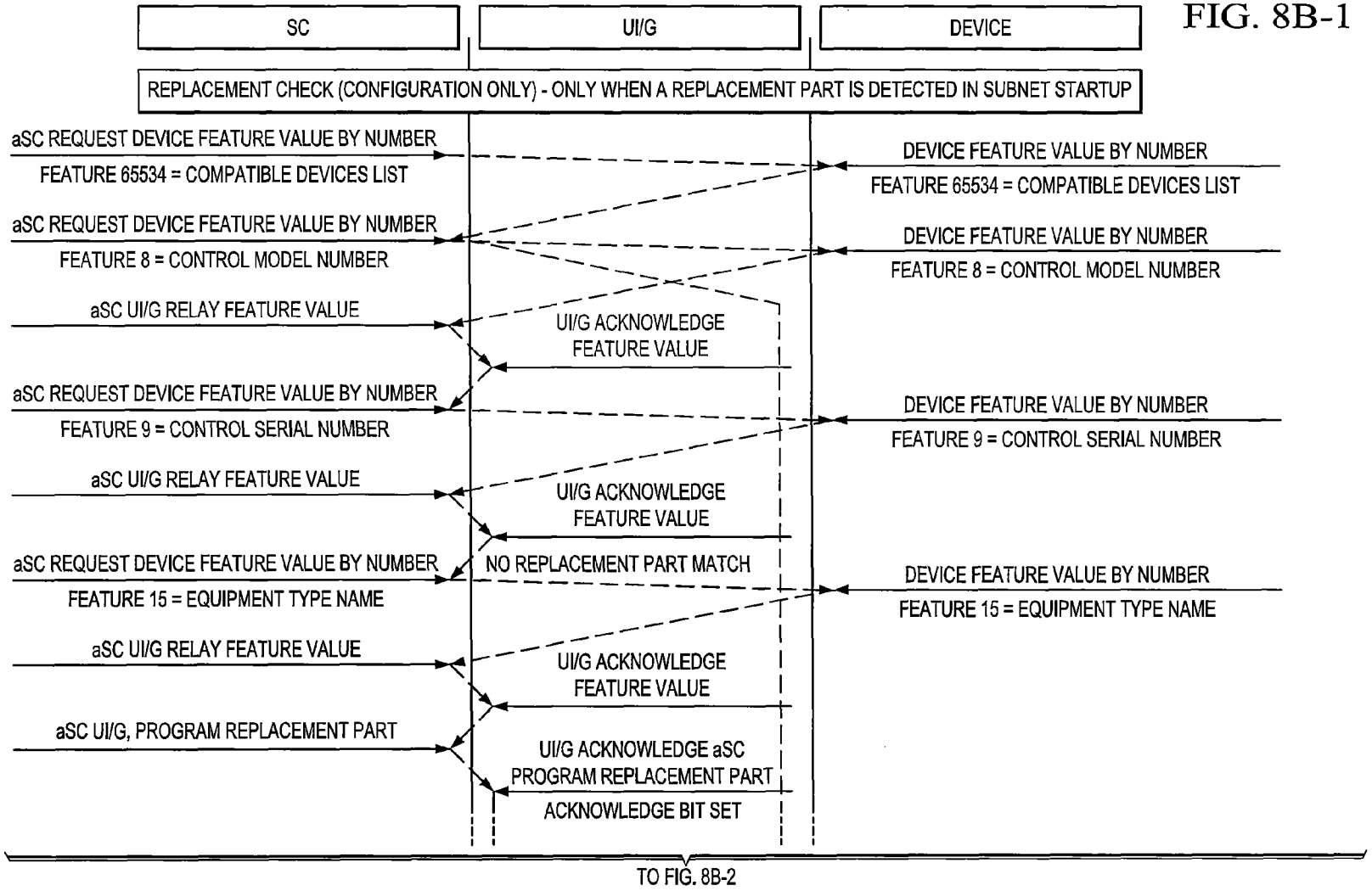
Figures 2, 8B:
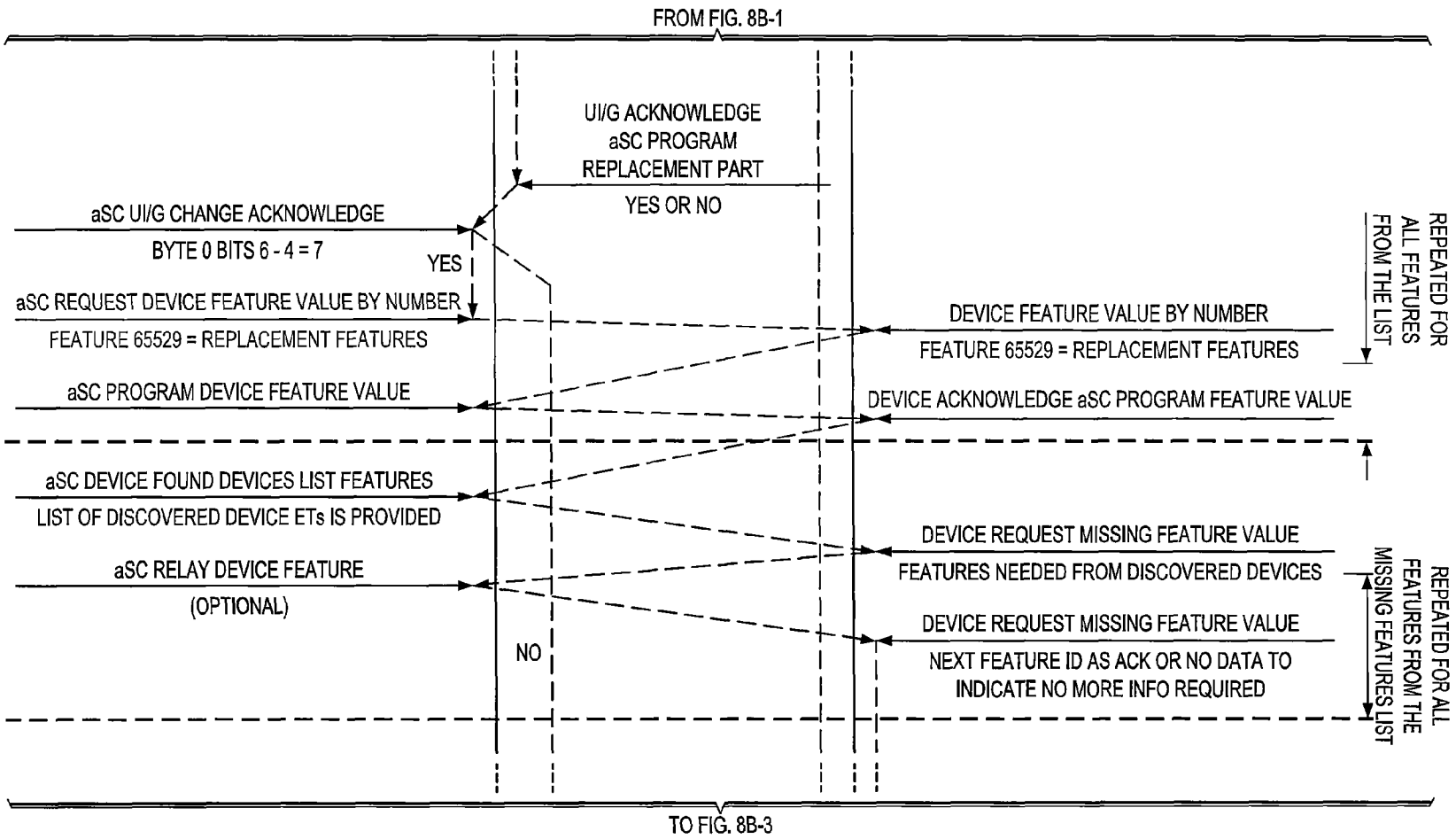
Figures 3, 8B:
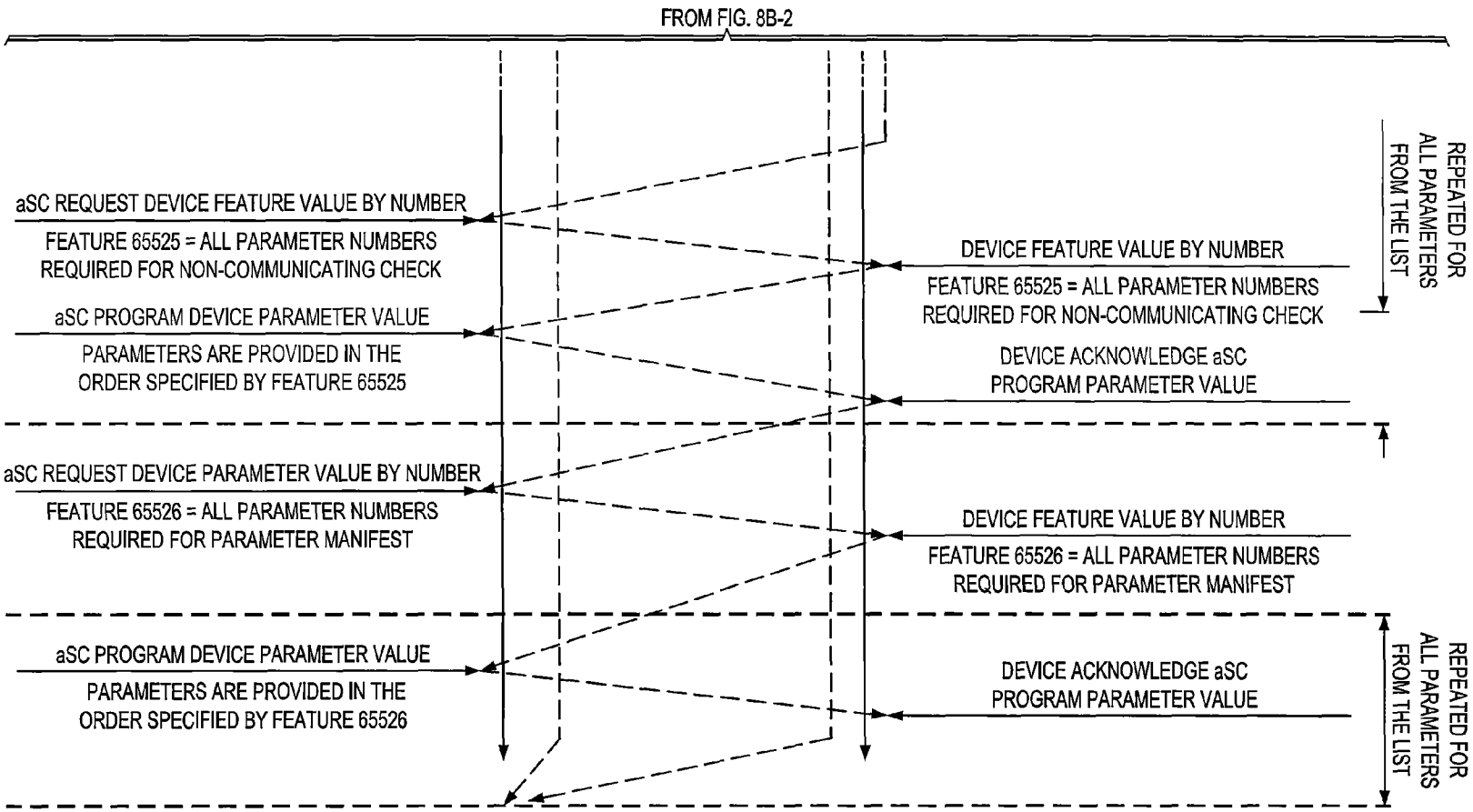

FIG. 8A illustrates an exemplary flow regarding controlling dependent parameters when a parameter of a first device is dependent upon a parameter of a second device of a subnet of an HVAC system; and FIG. 8B illustrates an exemplary signal flow associated with a "Replacement Check Message Flow" sub-states of commissioning state in an HVAC network.

DETAILED DESCRIPTION

As stated above, conventional climate control systems have been in wide use since the middle of the twentieth century and have, to date, generally provided adequate temperature management. However, it has been realized that more sophisticated control and data acquisition and processing techniques may be developed and employed to improve the installation, operation and maintenance of climate control systems.

Described herein are various embodiments of an improved climate control, or HVAC, system in which at least multiple components thereof communicate with one another via a data bus. The communication allows identity, capability, status and operational data to be shared among the components. In some embodiments, the communication also allows commands to be given. As a result, the climate control system may be more flexible in terms of the number of different premises in which it may be installed, may be easier for an installer to install and configure, may be easier for a user to operate, may provide superior temperature and/or relative humidity (RH) control, may be more energy efficient, may be easier to diagnose and perhaps able to repair itself, may require fewer, simpler repairs and may have a longer service life.

FIG. 1 is a high-level block diagram of an HVAC system, generally designated 100. The HVAC system may be referred to herein simply as "system 100" for brevity. In one embodiment, the system 100 is configured to provide ventilation and therefore includes one or more air handlers 110. In an alternative embodiment, the ventilation includes one or more dampers 115 to control air flow through air ducts (not shown.) Such control may be used in various embodiments in which the system 100 is a zoned system. In the context of a zoned system 100, the one or more dampers 115 may be referred to as zone controllers 115. In an alternative embodiment, the system 100 is configured to provide heating and therefore includes one or more furnaces 120, typically associated with the one or more air handlers 110. In an alternative embodiment, the system 100 is configured to provide cooling and therefore includes one or more refrigerant evaporator coils 130, typically associated with the one or more air handlers 110. Such embodiment of the system 100 also includes one or more compressors 140 and associated condenser coils 142, which are typically associated in one or more so-called "outdoor units" 144. The one or more compressors 140 and associated condenser coils 142 are typically connected to an associated evaporator coil 130 by a refrigerant line 146. In an alternative embodiment, the system 100 is configured to provide ventilation, heating and cooling, in which case the one or more air handlers 110, furnaces 120 and evaporator coils 130 are associated with one or more "indoor units" 148, e.g., basement or attic units.

For convenience in the following discussion, a demand unit 155 is representative of the various units exemplified by the air handler 110, furnace 120, and compressor 140, and more generally includes an HVAC component that provides a service in response to control by the control unit 150. The service may be, e.g., heating, cooling, or air circulation. The demand unit 155 may provide more than one service, and if so, one service may be a primary service, and another service may be an ancillary service. For example, for a cooling unit that also circulates air, the primary service may be cooling, and the ancillary service may be air circulation (e.g. by a blower).

The demand unit 155 may have a maximum service capacity associated therewith. For example, the furnace 120 may have a maximum heat output (often expressed in terms of British Thermal Units, or BTU), or a blower may have a maximum airflow capacity (often expressed in terms of cubic feet per minute, or CFM). In some cases, the addressable unit 155 may be configured to provide a primary or ancillary service in staged portions. For example, blower may have two or more motor speeds, with a CFM value associated with each motor speed.

One or more control units 150 control one or more of the one or more air handlers 110, the one or more furnaces 120 and/or the one or more compressors 140 to regulate the temperature of the premises, at least approximately. In various embodiments to be described, the one or more displays 170 provide additional functions such as operational, diagnostic and status message display and an attractive, visual interface that allows an installer, user or repairman to perform actions with respect to the system 100 more intuitively. Herein, the term "operator" will be used to refer collectively to any of the installer, the user and the repairman unless clarity is served by greater specificity.

One or more separate comfort sensors 160 may be associated with the one or more control units 150 and may also optionally be associated with one or more displays 170. The one or more comfort sensors 160 provide environmental data, e.g. temperature and/or humidity, to the one or more control units 150. An individual comfort sensor 160 may be physically located within a same enclosure or housing as the control unit 150. In such cases, the commonly housed comfort sensor 160 may be addressed independently. However, the one or more comfort sensors 160 may be located separately and physically remote from the one or more control units 150. Also, an individual control unit 150 may be physically located within a same enclosure or housing as a display 170. In such embodiments, the commonly housed control unit 150 and display 170 may each be addressed independently. However, one or more of the displays 170 may be located within the system 100 separately from and/or physically remote to the control units 150. The one or more displays 170 may include a screen such as a liquid crystal display (not shown).

Although not shown in FIG. 1, the HVAC system 100 may include one or more heat pumps in lieu of or in addition to the one or more furnaces 120, and one or more compressors 140. One or more humidifiers or dehumidifiers may be employed to increase or decrease humidity. One or more dampers may be used to modulate air flow through ducts (not shown). Air cleaners and lights may be used to reduce air pollution. Air quality sensors may be used to determine overall air quality.

Finally, a data bus 180, which in the illustrated embodiment is a serial bus, couples the one or more air handlers 110, the one or more furnaces 120, the one or more evaporator coils 130, the one or more condenser coils 142 and compressors 140, the one or more control units 150, the one or more remote comfort sensors 160 and the one or more displays 170 such that data may be communicated therebetween or thereamong. As will be understood, the data bus 180 may be advantageously employed to convey one or more alarm messages or one or more diagnostic messages.

FIG. 2 is a high-level block diagram of one embodiment of an HVAC data processing and communication network 200 that may be employed in the HVAC system 100 of FIG. 1. One or more air handler controllers ("AHCs") 210 may be associated with the one or more air handlers 110 of FIG. 1. One or more integrated furnace controllers ("IFCs") 220 may be associated with the one or more furnaces 120. One or more damper controller modules 215, also referred to as a zone controller module 215, may be associated with the one or more dampers 114 the interface the one or more dampers to the data bus 180. One or more AC controllers 225 may be associated with one or more evaporator coils 130 and one or more condenser coils 142 and compressors 140 of FIG. 1. The network 200 includes an active subnet controller ("aSC") 230*a* and an inactive subnet controller ("iSC") 230*i*. The aSC 230*a* is responsible for configuring and monitoring the system 100 and for implementation of heating, cooling, air quality, ventilation or any other functional algorithms therein. Two or more aSCs 230*a* may also be employed to divide the network 200 into subnetworks, or subnets, simplifying network configuration, communication and control. The iSC 230*i* is a subnet controller that does not actively control the network 200. In some embodiments, the iSC 230*i* listens to all messages passed over the data bus 180, and updates its internal memory to match that of the aSC 230*a*. In this manner, the iSC 230*i* may backup parameters stored by the aSC 230*a*, and may be used as an active subnet controller if the aSC 230*a* malfunctions. Typically there is only one aSC 230*a* in a subnet, but there may be multiple iSCs therein, or no iSC at all. Herein, where the distinction between an active or a passive SC is not germane the subnet controller is referred to generally as an SC 230.

A user interface (UI) 240 provides a means by which an operator may communicate with the remainder of the network 200. In an alternative embodiment, a user interface/gateway (UI/G) 250 provides a means by which a remote operator or remote equipment may communicate with the remainder of the network 200. Such a remote operator or equipment is referred to generally as a remote entity. A comfort sensor interface 260 may provide an interface between the data bus 180 and each of the one or more comfort sensors 160.

Each of the components 210, 220, 225, 230*a*, 230*i*, 240, 250, 260 may include a general interface device configured to interface to the bus 180, as described below. (For ease of description any of the networked components, e.g., the components 210, 220, 225, 230*a*, 230*i*, 240, 250, 260, may be referred to generally herein as a device 290. In other words, the device 290 of FIG. 2 is a proxy for any of a furnace, a heat pump, a subnet controller, etc, and that device's associated interface means.) The data bus 180 in some embodiments is implemented using the Bosch CAN (Controller Area Network) specification, revision 2, and may be synonymously referred to herein as a residential serial bus (RSBus) 180. The data bus 180 provides communication between or among the aforementioned elements of the network 200. It should be understood that the use of the term "residential" is nonlimiting; the network 200 may be employed in any premises whatsoever, fixed or mobile. In wireless embodiments, the data bus 180 may be implemented, e.g., using Bluetooth™ or a similar wireless standard.

Figure 3A:
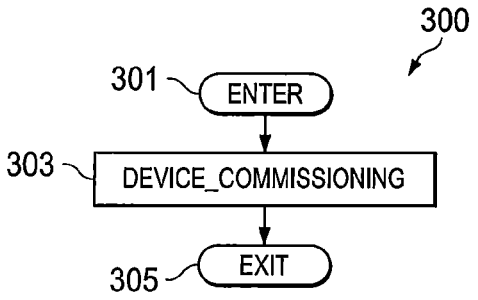
FIG. 3A is a diagram of a series of steps in an event sequence that depicts a device commissioning in an HVAC network having an active subnet controller.

Turning now to FIG. 3A, illustrated is a diagram 300 of a series of steps that occur in relation to a commissioning of the unit 155. The diagram 300 includes an enter state 301, a device commissioning state 303, and an exit state 305. The HVAC system 100 can be described as being partitioned into a plurality of subnets, each subnet controlled by its own active subnet controller 230*a*.

Device commissioning can generally be defined as setting operational parameters for a device in the network of the HVAC system, including its installation parameters. Generally, device commissioning 300 is used by the subnet controller 230 when it is active to: a) set operating "Installer Parameters" for a networked device, such as air handlers 110, (henceforth to be referred to collectively, for the sake of convenience, as the unit 155, although other devices are also contemplated), b) to load UI/Gs 240, 250 with names and settings of "Installer Parameters and Features" of the units 155, c) to configure replacement parts for the units 155, and d) to restore values of "Installer Parameters and Features" in units 155 if those "Parameters and Features" were lost due to memory corruption or any other event. Device commissioning is a process used in the HVAC system 100, either in a "configuration" mode or in a "verification" mode.

In the "configuration" mode, the unit 155 shares its information with the subnet controller 230*a* in an anticipation of being employable in the HVAC system 100, and an appropriate subnet. Generally, the commissioning process 300 provides a convenient way to change or restore functional parameters, both for the subnet controller 230*a* and the unit 155.

In both the "verification" mode and the "configuration" mode, the unit 155 is checked for memory errors or other configuration or programming errors. There are differences in device 260 behavior between the "configuration" mode and in the "verification" mode, to be detailed below.

The "subnet startup" mode programs the subnet controller 230 to be active. The "subnet startup" mode enables subnet communications, (i.e., communication within a subnet), and also deactivates a "link" sub-mode. A "link" mode may be generally defined as a mode that allows a number of subnets to work together on the same HVAC network 100, and that assigns subnet numbers for each subnet to allow this communication.

The "installer test" mode is employed when an installer installs and tests aspects and devices 110 of the HVAC system 100. The "normal operations" mode is an ongoing operation of units 155 of the HVAC system 100 in a normal use.

More specifically, the device commissioning state machine 300 can be employed with: a) the "configuration" mode, which is invoked when transitioning to the commissioning state from the "subnet startup mode" or "installer test" mode, or the "normal mode", or b) a "verification" mode. The "verification" mode is invoked when transitioning to the commissioning state from the "subnet startup" mode.

The following describes an illustrative embodiment of a process of commissioning 300 the HVAC unit 155, first for a "configuration" mode, and then for a "verification" mode. The process of commissioning differs from a "subnet startup," in that commissioning requires that the network configuration, including configuration and activation of subnet controllers 230, has already been completed before the commissioning 300 of the device 260 can start. Please note that there can be more than one subnet controller 230 on a subnet, but only subnet controller 230*a* is active at any one time.

In one embodiment, in order to enter into the state 320 of the process 300 in the "configuration" mode, the unit 155 receives either: a) an "aSC" ('active subnet controller') Device Assignment message", having "Assigned State" bits set to "Commissioning"; or b) a receipt of an "aSC Change State" message, with "New aSC State" bits set to "Commissioning," from the active subnet controller 230. For both "configuration" and "verification" modes, an "aSC Device Assignment" message can be generally regarded as a message that assigns the unit 155 to a particular active subnet controller 230*a*. For both "configuration" and "verification" modes, an "aSC Change State" message can be generally regarded as a message that starts and ends employment of the commissioning state diagram 300 for the units 155 and all other devices on the subnet.

In one embodiment, in the state 320 in the configuration mode, all units 155 respond to the "aSC Device Assignment" message with their respective "Device Status" messages, indicating that the units 155 are now in commissioning process 300 due to their response to this previous message. For both "configuration" and "verification" modes, the "Device Status" message can be generally defined as message that informs the active subnet controller 230*a* of what actions are being taken by the unit 155 at a given time.

However, alternatively, in other embodiments, in the state 320 in the "configuration" mode, if the units 155 are instead busy, as indicated by "aSC Acknowledge" bits of the "Device Status" message sent to the subnet controller 230*a* set as a "Control Busy," the active subnet controller 230*a* will wait for the busy units 155 to clear their "aSC Acknowledge" bits before proceeding with further elements of the Commissioning 320 process. The units 155 then resend their "Device Status" messages as soon as they are no longer busy.

From this point on, all units 155 send their "Device Status" messages periodically and on any status change, both during and after the commissioning 300. If the unit 155 does not clear its "aSC Acknowledge" bits within a minute (indicating its control is no longer "busy"), the active subnet controller 230*a* sends an "Unresponsive Device2" alarm for each such unit 155. If in "configuration" mode, the active subnet controller 230*a* remains in the waiting mode indefinitely, until the unit 155 responds correctly, or the subnet is reset manually or after a timeout is reached. In "verification" mode the active subnet controller 230*a* proceeds further to exit the state.

In the "configuration" mode, each unit 155 remembers all of its optional sensors that are currently attached to it. Furthermore, each unit 155 may store a local copy in its non-volatile memory ("NVM") of all of any other unit features that it is dependent on. A unit 155 feature can be generally defined as any datum that is fixed and cannot be changed by the installer, serviceman or the home owner. Changing of a "Feature" value normally involves reprogramming of the units 155 firmware.

In at least some embodiments, a feature is something that is fixed value, that is hard-wired into a device. In other words, no installer or home owner can change it. Features are programmed into the unit 155 during a manufacturing or an assembly process. Features can be recovered in a home, during a Data non-volatile memory ("NVM") recovery substate of Commissioning state only—the recovery substate happens automatically and without installer or user intervention. In a further embodiment, parameters can be changed by the installers only. In a yet further embodiment, the HVAC system 100 employs "variables"—those can be changed by the installers and also the home owners.

In some embodiments, a "Parameter List" is normally a Feature that contains a special list of specific parameters included in the unit 155. Parameter values can be changed, and their state can be changed also (from enabled to disabled and vice-versa), but their presence is set once and for all in a given firmware version. Therefore, a list of Parameters (not their values) is also fixed, and is thus treated as a "Feature."

However, although elements of the "configuration" mode commissioning and "verification" mode commissioning are similar, when the active subnet controller 230 is in "verification" mode instead of in "configuration" mode, the active subnet controller 230*a* can exit commissioning 300 regardless of the value of the alarms of the units 155. However, alternatively, if the active subnet controller 230*a* is in "configuration" mode, the active subnet controller 230*a* will not exit from its commissioning state 300 for as long as at least one unit's 155 "aSC Acknowledge" flags are set to "Control Busy." In one embodiment of the "verification" mode, the active subnet controller 230*a* timeouts the installation and resets the subnet to default parameters.

In the "verification" mode, assuming the unit 155 operates with a non-corrupted (original or restored copy) NVM, each unit 155 checks any of its attached sensors to see if they match with the parameters that were present in a most recent configuration of the unit 155. In some embodiments, alarms are generated by the unit 155 for missing or malfunctioning sensors as soon as the faulty condition is detected, to be employed by the user interfaces and gateways present on the subnet to notify the installer or homeowner of the encountered problem. The unexpected absence of certain sensors may inhibit the operation of the unit 155 or the subnet. This is normally manifested by the signaling of the appropriate Service Bits in the Device Status message used by the active subnet controller 230*a*, to determine the operational viability or health of the subnet's systems.

In some embodiments, the device commissioning process 300 then transitions into a state 330, and then ends, upon either: a) the last unit 155 receiving all of unit 155 parameters that it is dependent on, when in "verification" mode; or b) upon a request by a user, when in "configuration" mode. The active subnet controller 230*a* then proceeds to ensure that no subnet unit 155 has its "aSC Acknowledge" flag set to a "Control Busy" state. The "aSC Acknowledge" flag not being set indicates that all of a non-volatile memory of a given unit 155 had been written to with the necessary parameters. If no "Control Busy" state is detected, the active subnet controller 230*a* then issues the "aSC Change State" message, which forces the unit 155 from a commissioning state to a non-commissioning state, in either a "configuration" or a "verification" mode.

In some embodiments, when the unit 155 in the process 300 fails its NVM data integrity check in an "NVM Check State," and the active subnet controller is unable to perform NVM Recovery, the unit 155 instead employs its default data stored in its non-volatile (Flash) memory and/or uses default calculations to initialize the data dependent on other devices in the system. The other device data to be used for commissioning could have been obtained in either the "verification" or "configuration" mode. For data or other parameters that were not transferred or generated as part of that commissioning 300 session, default values are used.

In one embodiment, upon a detection of a system configuration error, such as a missing device whose features or parameters the unit 155 depends upon, it uses the locally stored copy of the other device's features that it depends upon, and ignores any potential feature value conflicts. In another embodiment, the unit 155 uses the locally stored copy of other parameters of the unit 155 that it depends on and ignores any potential dependent parameter value conflicts. In other words, the unit 155 employs a first installed parameter as a template for a second installed parameter on a second device. In a third embodiment, the unit 155 will change its parameter or feature values only if explicitly instructed by the active subnet controller 230 or the UI/G 240, 250.

The system 100 may be configured to limit allowed configurations of units 155. For example, it may be determined that certain configurations of the system 100 are undesirable or incompatible with proper operation of the various units 155. In various embodiments the various units 155 in the subnet are assigned credentials during commissioning to operate on the subnet. The aSC 230*a* may be configured to ignore a request made during the commissioning state from a unit 155 outside a permitted configuration set from registering with the aSC 230*a* to prevent undesired or unpredictable operation that might otherwise result.

Figure 3C:
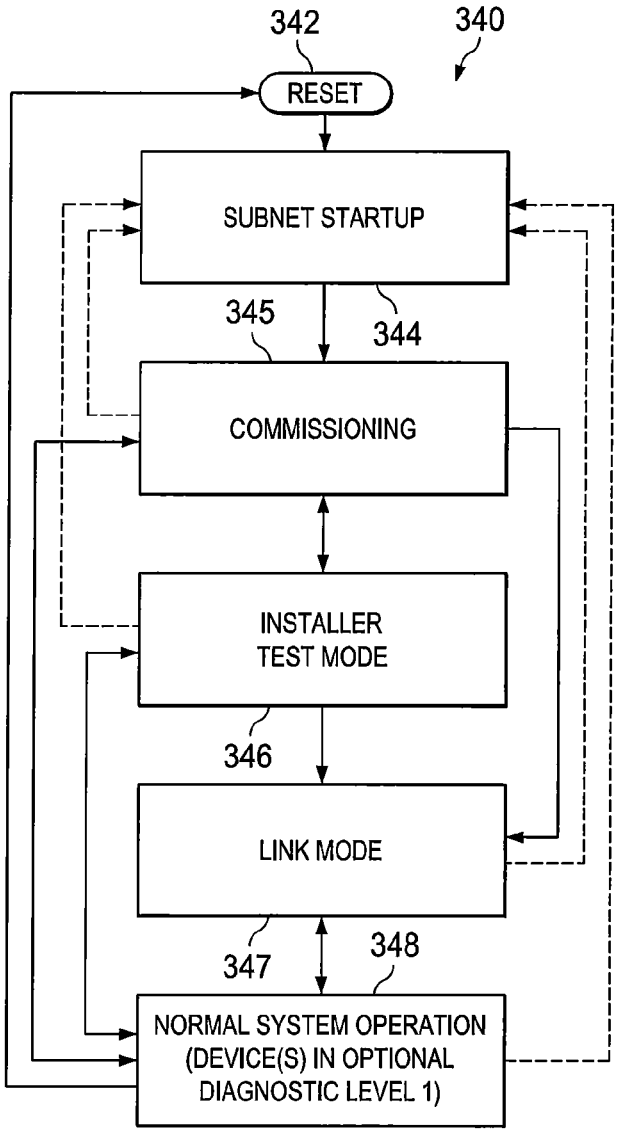
FIG. 3C is a diagram of the above series of steps of FIG. 3B to be followed by a subnet controller to synchronize with a device of the HVAC system.
Figure 3B:
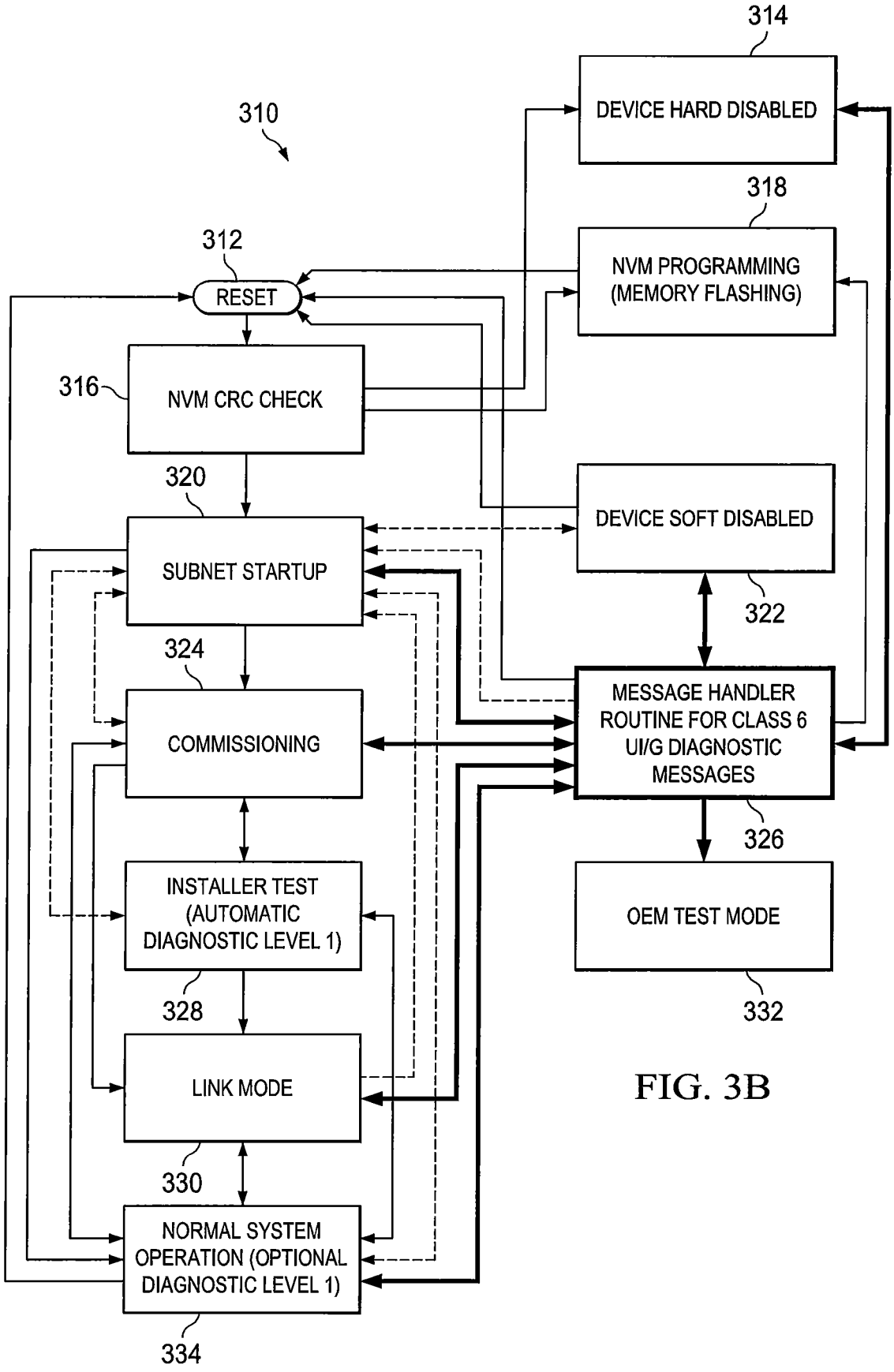
FIG. 3B is a diagram of a series of steps that occur in relation to a commissioning of a subnet including an addressable unit.

Turning now to FIG. 3B, illustrated is an HVAC device state machine 310 illustrated for a subnet, including the unit 155, in more detail. Solid lines indicate normal state transitions when the subnet is transitioning from one state to another state, green lines indicate a subroutine call and red lines, alternating dotted and dashed lines indicate unexpected yet valid transitions. All states other than state 326 represent device states, and the state 326 represents a message handling routine.

As is illustrated in the present embodiment, a reset state 312 of a subnet advances to a NVM CRC check 316 for a given device (such as unit 155). If the device fails the test, the device advances to a NVM programming 318. If the device passes, however, then in subnet startup 320, the device is assigned an address (Equipment Type number) and some features and parameters of the unit 155 may be shared with the subnet. Then, in substate 324, device commissioning as described in FIG. 3A occurs. This then leads to an installer test state 328. This, in turn, then leads to a link mode startup 330, as described above. Finally, then in a step 334, normal system operation occurs, although system can reset to state 312 or be brought to states 314 or 332 via diagnostic messages handled in a state 326.

In a further embodiment, during the NVM CRC check 316, the state machine 310 can advance to a NVM programming state 318. This can occur due to such factors as a failure of a non-volatile memory, or an initial programming of the NVM. In a yet further embodiment, each of these units 155 is programmed to deal with one form of a diagnostic message regarding system errors in a state 326, and from there to testing the device 160 itself in an OEM test mode 332.

Turning now to FIG. 3C, illustrated is a state flow diagram 340 for the active subnet controller 230 in relation to the unit 155. Generally, is the responsibility of the active subnet controller 230*a* to implement proper state transitions. The other units 155 follow the explicit direction of the aSC 230*a* for all valid transactions. These state diagrams are included to help ensure that a state of the unit 155 is the same as the subnet controller. The SC 230*a* is responsible for device synchronization. If the unit 155 is detected out of synch with the rest of the system, the aSC 230*a*, in some embodiments, immediately tries to bring the unit 155 to the current system state, if possible.

If an addressable unit 155 is detected in subnet startup 342, the subnet controller 230*a* applies asynchronous startup rules, which generally pertain to how many parameters are to be passed between device 160 and the active subnet controller 230*a*.

If an addressable unit 155 is detected in commissioning 345, installer test 346, link mode 347 or normal operation 348 substates, the unit 155, in some embodiments, is brought to the current state via a resend of an "aSC Change State" message, which involves transitioning from a first current aSC state to a second current aSC state.

In some embodiments, if a unit 155 is detected in OEM Test or Soft Disabled state, the unit 155 shall be reset by the active subnet controller 230*a* in a step 342. If a unit 155 is detected in "Hard Disabled" or "NVM Programming" state, the active subnet controller 230*a* assumes that it is not available on the subnet In a further embodiment, inactive subnet controllers 230*i* are required to keep the most up to date subnet and HVAC system configuration information. Inactive subnet controllers 230*i* listen to all UI/G and aSC messages and continuously update their non-volatile memory to attempt to be as consistent as possible with the settings stored in active subnet controller 230*a*.

Various Aspects of Updating Variable Parameters in Communicating and Non-Communicating Devices There are various approaches to updating parameters within addressable units 155, which will first be introduced, and discussed in more detail below.

a) retrieving both fixed and non-fixed parameters from the device 155 of the HVAC network 155, and allowing a user to update the non-fixed parameters of the HVAC network, such as described regarding FIG. 4B, below;

b) updating parameters when the updated values of one set of variable parameters within the HVAC addressable unit 155 are dependent upon the values of another parameter within the same device, such as described regarding FIG. 4C, below.

c) updating parameters of a second non-communicating device when the value of a non-communicating device is updated by a communicating device with the employment of "non-communicating parameters," such as is described regarding FIG. 5, below. In other words, a list of variable parameters, itself a feature, is used to update the non-communicating device;

d) updating parameters of first unit 155 when a first device depending upon the features (non-changing parameters) of the second unit 155, such as is described regarding FIG. 6, below. For example, the unit's parameter value depends on the other device's feature value. For example the default "High Cooling CFM" setting is calculated and its possible range is adjusted based on the tonnage of the outdoor unit. So, if the outdoor unit's tonnage is 4 ton than the High Cooling CFM is limited to range 1400 to 1600 (3.5*OU tonnage to 4*OU tonnage).

e) when a change of a variable parameter of a first device is dependent upon a change of a variable parameter of a second device, and this change gets propagated through an HVAC system, such as discussed regarding FIGS. 7A and 7B, below. For example, a value of sensor "zone number" parameter may be dependent on the value of "total number of zones" parameter, so that one sensor is not mistakenly assigned to a zone number that does not exist.

Turning now to FIG. 4A, illustrated is an exemplary method 400 for updating variable device parameters within devices of the HVAC network 200 of the HVAC system 100. This flow generally applies to subsection "a", above. For ease of explanation, addressable units 155 may be interchangeably referred to as "devices" for the rest of this document. After a start step 402, in a step 410, all fixed parameters are retrieved from all networked devices on an HVAC subnet, and these variable parameter values are stored to a user interface, such as user interface 240. In a step 415, in some embodiments, all variable parameters are retrieved from all networked devices on the HVAC subnet and are stored in the user interface. In a step 417, a user is given an option by the user interface to modify a value of a variable parameter of at least one networked device of the subnet.

Turning now to FIGS. 4Bi and 4Bii, illustrated is an exemplary flow diagram for a method 425, such as may be employed with the above commissioning steps of the subnet 400, that updates parameters within an HVAC device that are dependent upon other parameters that are stored or updated within that same device. This can relate to situation "b", described above.

In the exemplary method 425, after a start step 430, in a step 435, a UIG (either a user interface or a gateway that can include a user interface) sends a device parameter value change message to a device, such as the addressable unit 155, with an updated value of an installer parameter.

In one embodiment, in a step 440, an HVAC networked device determines whether a parameter definition, received from the UIG 405, has changed. An example of a changed parameter definition would be a change of a flag from enabled to disabled for a given networked device. If the parameter definition has not changed, the method advances to step 455. If the parameter definition has changed, in a step 445, the device sends a "Device UIG Parameter Definition by Number" message to the UIG 405 that contains the new parameter definition. Then in step 450, the device sends a "Device UIG Parameter Value by Number" message containing the parameter value and its flags for all other affected parameters in the same group. For example, if a comfort level parameter were changed, this could affect a humidity range that is allowable, and a work schedule for the networked HVAC device, all of which could be related parameters within the same device.

In an exemplary further embodiment, an enable/disable flag indicates if a parameter is currently applicable based on values of the other parameters within the device. After a "UI/G DEVICE Parameter Value Change" is received, the IFC 220 will send parameter value messages for every parameter that changed its enabled/disabled status due to that parameter value change. After those messages are transmitted, the IFC 220 sends an appropriate acknowledge message to confirm the parameter value update.

In a step 455, it can be determined by the networked HVAC device, such as the device 410, whether a parameter update is within an allowed range. If the parameter update is within an allowed range, the networked HVAC device updates its own internal memory to include a copy of the updated parameter that was found to be within range by the networked HVAC device in a step 460. If the parameter update is not within the allowed range, the HVAC networked device keeps its previous parameter value in a step 465.

In a step 470, the networked HVAC device, such as the device 410, can send the UIG the parameter value now stored within in the device, which can be either the updated parameter value or the previous parameter value, as determined in the step 455. In a step 475, the UIG relays all changed parameters to an active subnet controller, such as the active subnet controller 415. In a step 480, the active subnet controller updates its stored backup parameter values and acknowledges all changed parameters that were forwarded from the UIG, such as the UIG 405.

In a step 485, the UIG can relay all of the changed parameter values received from the networked HVAC device, such as the device 410, to other HVAC devices (not illustrated) on the subnet that have registered a parameter dependency that matches a changed parameter of the device 410. This registration process can occur when the active subnet controller had previously forwarded to the UIG an "aSC Device Found Devices List Parameters" received in a "parameter scan" state of the active subnet controller during an activation sequence of the active subnet controller.

In a step 490, the UIG determines whether all of any other HVAC networked devices on the subnet have updated their parameters that depend upon the updated parameter and acknowledged such. If it is determined a given networked HVAC device has not acknowledged its updated parameters, the exemplary method 400 can loop back to step 435, and has that device go through the method 420 for its new parameter. If it is determined that all other devices have updated the appropriate parameters, then the method stops in a step 490.

Turning now to FIG. 5, illustrated is an exemplary flow for a method 500 for commissioning a networked HVAC device that is a non-communicating device. This corresponds to situation "c", described above, wherein a communicating device commissions a non-communicating device. Generally, in the method 500, a communicating device can mimic a non-communicating device so that the installer programs the communicating device in lieu of the non-communicating device. The communicating HVAC device then programs non-communicating HVAC device through use of a feature set of definitions of variable parameters that are programmed within the first device.

Generally, the exemplary method 500 can allow a communicating device, defined as an HVAC device that can directly communicate with an installer, the communicating device often being an indoor HVAC device, to set its own internal parameters and to also operate with another HVAC device that is either communicating or non-communicating device of a same type, i.e., a device that can not directly communicate with an installer. The non-communicating device can be an outdoor device, although not all outdoor devices are non-communicating units. Generally, information about non-communicating equipment is stored as fixed parameter types in a feature manifest in the various communicating units 155, e.g. indoor units that can program this non-communicating equipment, e.g. outdoor units.

In one embodiment, before entering into the method 500, if during a "feature manifest communication" in the configuration process of the commissioning 300, if the IFC 220 did not recognize a presence of a communicating outdoor unit, such as a communicating Humidifier or Dehumidifier, as opposed to a non-communicating device, the IFC 220 will enable its own non-communicating parameters for those missing devices. These parameters, although they represent variables, the types of parameters are fixed and part of the feature manifest. When requested by the active subnet controller 230, the IFC 220 sends all "non-communicating parameters" with enabled/disabled flag based on the communicating feature manifest of the other communicating devices on the subnet.

Generally, default parameter values for non-communicating and installer parameters are then loaded into the non-volatile memory of the communicating devices 110 on first entry in configuration (commissioning state, such as discussed in the state diagram 300, above), and also when diagnostic inquiry command "Set Default Installer Parameter Values" is executed.

In the exemplary method 500, after a start step 510, a communicating HVAC device checks for both a communicating and a non-communicating device of a sake kind in a step 515, such as through employment of a "Non_Comm_Check_Scan State" enquiry. A goal of a "Non_Comm_Check_Scan State State" is to inquire of an installer or the subnet controller 230, which is an active subnet controller, what non-communicating equipment there is attached to the communicating devices.

In a step 520, it can be determined whether a found device on a HVAC subnet during a manifest check is a non-communicating device or a communicating device. If the found device is a communicating device, the method 500 advances to a stop step 530. However, if the found device is not a communicating device, in a step 525, the communicating device allows an installer to program the non-communicating device, through a programming of known fixed-type parameters, the parameter types are stored in the communicating device as part of the feature manifest. The communicating unit 155 then conveying the fixed type but variable value parameters to the non-communicating device. The internal features of the non-communicating device typically mimic features of a communicating device when being installed by an installer.

In one embodiment of the method 500, the information about non-communicating equipment is stored as parameter types in the devices that directly control this equipment, e.g., indoor units, which would therefore be communicating devices. The process of configuring the non-communicating equipment can be equivalent to updating parameter values. This state is optional and it is only entered when in configuration mode.

For example, with the non-communicating parameter "Non-communicating Outdoor Unit" initially at default value (0=no non-communicating outdoor unit attached to the IFC), both the "Non-communicating Outdoor unit capacity" and the "Minimum non-communicating outdoor unit capacity" are disabled (not applicable) parameters. If the "Non-communicating Outdoor Unit" is changed to "2 stage A/C" unit, both parameters will become enabled (applicable) and the IFC 220 will send "Device Parameter Value By Number" messages with the enabled bit set for both parameters followed by the message to confirm the "Non-communicating Outdoor Unit" parameter change. This is applicable for all IFC parameters within a same group/list. The IFC 220 stores the non-communicating parameter values in non-volatile memory and protects them with a checksum. These values can then be employed by the networked HVAC device.

The above example employs device parameter dependencies using the non-communicating parameters. Non-communicating parameters can also be dependent on one another.

Turning now to FIG. 6A, illustrated is an exemplary flow of a method 600 for commissioning the parameters of the addressable unit 155 wherein its own internal parameters when parameter validity of the networked HVAC unit 155 depend upon network configuration and/or other device manifest features of a second device. This generally corresponds to situation "d", discussed above.

Various device internal parameters are configured differently, depending upon other feature parameter values (i.e., permanent) components of the network 200 of the HVAC system 100. In a further embodiment, the method 600 allows for one device to set its own internal parameters and operating modes, based on information published by other devices 110 on the subnet, without an involvement of the active subnet controller 230*a*.

An example of commissioning parameters when internal parameters and parameter validity depend upon network configuration and/or other device features of a second network device is programming an indoor unit blower having a cubic feet per minute (CFM) speed for outdoor units having various numbers of heating or cooling stages. During the commissioning process 300, the unit 155 listens to an "outdoor unit feature manifest" and then sets its own internal parameter values as well as parameter validity, i.e., whether the parameter is enabled or disabled. An "outdoor unit feature manifest" can be generally defined as a manifest of parameter types of outdoor units for a subnet, and their parameter values. Indoor units can calculate default values, such as whether a given parameter setting is applicable for the unit 155 of the HVAC system 100 for HVAC network 200 operation or not, and send the information to the installer. For example, setting a "Low Cooling CFM" for a 1-stage outdoor unit 155 is not applicable. Similarly, the indoor unit 155 can monitor for the presence of other accessories such as a "Humidifier" and "Dehumidifier," and set its own internal parameters as determined by these devices, as well.

In the exemplary method 600, after a start step 610, a plurality of devices, one of which can be an indoor device, enters the commissioning process 300. In a step 620, the device reads a feature manifest of the second device, which is a listing of what permanent features are available and disclosed to the device. In a step 625, the first device sets its own parameter validity as determined by an element of the outdoor feature manifest. In a step 630, the first device 155 sets its own internal parameter value as determined by the outdoor feature manifest.

In a step 635, the first unit 155 informs an installer on the validity and value of the set parameter. In a step 640, it is determined if there is yet another HVAC device on the subnet. This can be determined by finding indicia of another outside device in the outdoor feature manifest. If there is another device, then the method loops back to step 615, and the device looks at parameters of yet another device, and uses the parameters of the yet another device to set its own parameters, and again transitions through the method 600. If there is not another device, the method 600 stops in a step 645.

Turning briefly now to FIG. 6B, illustrated is an exemplary overview of a messaging flow messages implemented in a commissioning state between the subnet controller 230*a*, the UIG 250, and the unit 155, and includes messages in the beginning and an end of the state. For example, FIG. 6B illustrates both the "Device Status" message and the "GUI Status state" discussed above.

Turning briefly now to FIG. 6C1, illustrated are exemplary communication flows for a "non-communicating check scan and parameter scan" message flow. As is illustrated, various messages, such as a "Device Dependent Parameter List" and corresponding definitions are provided. This flow can be employed in conjunction with the method 600.

Turning briefly now to FIG. 6C2, illustrated is an exemplary "Non-Communicating Check Update and Parameter Update" message flow. As a plurality of devices 110 are disclosed as having their parameters modified, such as by the "Device UI/G Parameter Value By Number" message to a first unit 155 and the device 2 110. This flow can also be employed by the method 600.

Turning now to FIG. 7A1, illustrated is an exemplary method 700 for updating and propagating a value of an internal parameter of a first device when the value is dependent upon a second device. After a step start 710, in a step 720, devices on a subnet of the HVAC 100 enter into the commissioning process. In a step 730, each device publishes its own variable parameter values. In a step 735, the ASC 230*a* asks all devices whether they have read various variable parameters, such as all necessary variable parameters. If all devices have read all variable parameters, the flow stops in a step 745. However, if they have not, the in step 740, the ASC commands the devices having the needed variable value information to republish all necessary parameters in a step 740, and the method again asks all devices in the step 735.

Turning now to FIG. 7A2, illustrated is a method 750 for updating variable parameter values in an HVAC network 200 through employment of a user interface, such as user interface 240. After a start step 752, in a step 754, a user interface asks each device for a list of dependent parameters.

In a step 756, it is determined whether a user has modified a value of a variable parameter of a first device of the HVAC network from which a second device depends? If no, then the method ends in a stop step 768. However, if yes, then in a step 758, the second device updates and confirms acceptance of the new parameter value to user interface.

In a step 758, the user interface conveys the modified parameter value to the second device employing the variable parameter. In a step 760, the user interface conveys the modified parameter to the second device employing the variable parameter.

In a step 762, it is determined whether a selected device, which can be a third device, a fourth device, and so on, has a variable parameter within it from which a yet still further device depends, which can be a fifth device, a sixth device, and so on. If not, the method ends in a step 768. However, if yes, in a step 764, the selected device updates and confirms acceptance of the new parameter value to the user interface. In a step 766, a user interface conveys modified parameter values to the further device that employs the variable parameter. In one embodiment of the flow 700, the method ends in the stop step 768. In another embodiment, the flow loops back to step 762.

Turning now to FIG. 7B, illustrated is an exemplary high level block diagram of commissioning steps of an embodiment of a subnet 770 including a user interface or gateway ("UIG") 775 coupled to a device 780, which can be the unit 155, and an active subnet controller 785. These commissioning steps can be used with method 700, which corresponds to situation described above.

In one embodiment, the active subnet controller 785 enters the commissioning state when an installer interacts with a given device 780 and updates its "Installer Parameters" in a configuration mode. The active subnet controller 785 can also verify in a verify mode.

In FIG. 7B, in state transition "1)," the UIG 775 sends a "UI/G Device Parameter Value Change" message with a new value of an installer parameter "A." The device 780 updates the value of the requested parameter "A," if possible. This can correspond to step 720 of the flow 700.

In an optional state transition "2)," after updating, the device 780 responds with a "Device UI/G Parameter Number Definition By Number message" if the definition of the parameter was changed. The unit 155 further responds with a "Device UI/G Parameter Value By Number" message for each other parameter that was affected by the new value of "A," as long as these newly updated parameters are within the same group, either a non-communicating scan or parameter scan. This can correspond to a step 730 of the flow 700.

A "non-communicating group" can be generally defined as a group of parameters that pertain to a device that can not be directly updated by an installer, but instead by another device 780 or active subnet controller 785. A "parameter group" in this context can be generally defined as a group of parameters that can be directly altered by an installer.

In state transition "3)," the device 780 responds with a "Device UI/G Parameter Value By Number" message for parameter "A." This message includes the following: parameter number, current value of the parameter, its enable and structure change flags. If the requested parameter change (for the parameter "A") is outside an acceptable range, the device 780 responds to the UI/G 775 with an unchanged value, i.e., the current value of parameter "A" stored in the device 780, in the "Device UI/G Parameter Value By Number" message. In any event, upon receipt of this message, the UIG 775 can update all changed installer parameters with their new values. This can also correlate to step 730.

In a state transition "4)," the UIG 405 then relays all changed installer parameters to the ASC 415. In a state transition "5)," the ASC 415 acknowledges to the UIG 405 all changed installer parameters. This can correlate to the step 735.

In a further state transition (not illustrated), the UIG 405 then relays the new installer parameter values to other devices 410 (not illustrated) that have registered any of the installer parameters just changed in their "Device Dependent Parameters List" messages sent to the UIG 405 in previous "Parameter Scan" state. This continues until all updates are made with all devices by all devices that depend upon these changed parameters, and acknowledged by them. The UIG 405 keeps track of all device features and parameters for all devices 410 on the subnet based on the information previously forwarded to it, in the preceding commissioning state substates, by the active subnet controller 415. This can also collate to the step 735 and the step 740.

One employment of the state diagram illustrated in the diagram of FIG. 7B is directed towards allowing a configuration of parameters of the device 410 that are in turn, themselves dependent upon other values within the device 780. In a further embodiment, a plurality of other devices 780 having parameters are updated as a result of updating this device 7800.

For example, the IFC 220, in conjunction with the UIG 405, for setting Gas Heating Airflow device dependent parameters. The IFC parameters "Low Heating Airflow," "High Heating Airflow," "Low Discharge Air Temperature" and "High Discharge Air Temperature" are dependent on the value of the IFC parameter "Heating Airflow Control Type" ("HACT" parameter). "Low Heating Airflow" and "High Heating Airflow" dependent parameters are enabled, and thus shown to the installer when the "HACT" param=0. However, if the "HACT" param=1, the last two parameters are enabled and shown to the installer. The installer modifies the parameters seen by him or her on the UIG, but not the unseen parameters Turning now to FIG. 8A, illustrated is an exemplary method flow 800 regarding controlling dependent parameters when a parameter of a first device is dependent upon a parameter of a second device of a subnet of an HVAC system, as initiated in system state machine, primarily in the subnet controller. After an enter step 802, in a step 804, it is determined whether a subnet controller is in configuration mode. If it is, then in step 806, variable parameters are propagated, such as discussed in flow 7009. The method 800 then advances to step 808, wherein it is determined whether any device has non-volatile memory (NVM) corrupted. If yes, then a NVM backup data routine is initiated in a step 810. In a step 812, it is again determined whether the subnet controller is in configuration mode.

If not, then in a step 826, either a full or abbreviated feature manifest is generated by the device at the behest of the subnet controller. In a step 828, a non-communicating parameter scan is generated by the subnet controller for a given device. Then in a step 830, a full or abbreviated parameter scan is generated within the device 130, and the method ends in a step 832.

Alternatively, in a step 814, if the state of the subnet is in configuration mode, in a step 814, a replacement check for all devices is performed. In a step 816, a full feature manifest is then performed on the various HVAC devices. In a step 828, a non-communicating parameter scan is generated by the subnet controller for a given device. Then in a step 822, a full or abbreviated parameter scan is generated within the device 130, and the method ends in a step 832. Then, in a step 824, a parameter update, such as described in FIGS. 5-7B, is performed.

Turning now to FIG. 8B, illustrated is a FIG. 8B illustrates an exemplary signal flow associated with a "Replacement Check Message Flow" sub-states of commissioning state in an HVAC network.

Those skilled in the art to which this application relates will appreciate that other and further additions, deletions, substitutions and modifications may be made to the described embodiments.

What is claimed is:

1. A method for conveying information between a communicating first device and a second device coupled to said communicating first device of a HVAC network, comprising:

checking a subnet of said HVAC network for a second device by said communicating first device;

determining whether said second device is a non-communicating device; and allowing an installer to set internal parameters of said second device through employment of said first communicating device if said second device is said non-communicating device;

wherein said first communicating device is a HVAC component device providing at least one service in response to a control unit.

2. The method of claim 1, wherein said non-communicating device is a device that communicates through said first communicating device during an installation instead of directly with an installer.

3. The method of claim 1, wherein said first communicating device conveys said internal parameters to said second, non-communicating, device after said installer sets said parameters into said communicating.

4. The method of claim 1, wherein said internal parameters mimic parameters employed in said non-communicating second device to said installer.

5. The method of claim 1, wherein said first communicating device and said second device are coupled to a subnetwork of said HVAC that is controlled by an active subnet controller.

6. The method of claim 1, wherein said second device is an outdoor unit.

7. The method of claim 1, wherein said internal parameters are associated with subnet communications of said second device.

8. An HVAC system, comprising:

a first communicating device; and a second device coupled to said first communicating device;

wherein said first device is configured to determine if said second device is a non-communicating device and allow an installer to set internal parameters for said non-communicating device, and said first device is a HVAC component device providing at least one service in response to a control unit.

9. The system of claim 8, wherein said non-communicating device is a device that communicates through said first communicating device during an installation instead of directly with an installer.

10. The system of claim 8, wherein said first communicating device is configured to convey said parameters to said second non-communicating device after said installer sets said internal parameters into said first communicating device.

11. The system of claim 8, wherein said internal parameters mimic parameters employed in said non-communicating second device.

12. The system of claim 8, wherein said first communicating device and said second device are coupled to a subnetwork of said HVAC, said subnet controlled by an active subnet controller.

13. The system of claim 8, wherein said second device is an outdoor unit.

14. The method of claim 8, wherein said internal parameters are associated with subnet communications of said second device.

15. An HVAC system, comprising:

a first communicating device; and a second device coupled to said first communicating device;

wherein said first device is configured to determine if said second device is a non-communicating device and allow an installer to set internal parameters for said non-communicating device, wherein said installer sets said internal parameters through employment of an Internet, and said first device is a HVAC component device providing at least one service in response to a control unit.

16. The system of claim 15, wherein said non-communicating device is a device that communicates through said first communicating device during an installation instead of directly with an installer.

17. The system of claim 15, wherein said first communicating device is configured to convey said internal parameters to said second non-communicating device after said installer sets said internal parameters into said first communicating device.

18. The system of claim 15, wherein said internal parameters mimic parameters employed in said non-communicating second device.

19. The system of claim 15, wherein said first communicating device and said second device are coupled to a subnetwork of said HVAC, said subnet controlled by an active subnet controller.

20. The method of claim 15, wherein said internal parameters are associated with subnet communications of said second device.

* * * * *

UNITED STATES PATENT AND TRADEMARK OFFICE

CERTIFICATE OF CORRECTION

PATENT NO. : 8,463,443 B2
APPLICATION NO. : 12/603528
DATED : June 11, 2013
INVENTOR(S) : Wojciech Grohman et al.

It is certified that error appears in the above-identified patent and that said Letters Patent is hereby corrected as shown below:

In the Specification

Column 1, line 1, after the word "of" please insert --U.S. Provisional Application Ser. No. 61/852,676, filed by Grohman, et al., on April 7, 2009, entitled "Comprehensive HVAC Control System," and--

Signed and Sealed this
Sixth Day of August, 2013

Teresa Stanek Rea
*Acting Director of the United States Patent and Trademark Office*